US006286493B1

(12) United States Patent
Aoki

(10) Patent No.: US 6,286,493 B1
(45) Date of Patent: Sep. 11, 2001

(54) CONTROL DEVICE FOR AN AIR-FUEL RATIO SENSOR

(75) Inventor: Keiichiro Aoki, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/510,645

(22) Filed: Feb. 23, 2000

(30) Foreign Application Priority Data

Mar. 4, 1999 (JP) ..... 11-057322

(51) Int. Cl.[7] ..... F02D 41/14
(52) U.S. Cl. ..... 123/690; 73/117.3; 73/23.32
(58) Field of Search ..... 123/690, 674, 123/681, 676, 678; 60/285, 276; 73/23.32, 117.3, 118.2

(56) References Cited

U.S. PATENT DOCUMENTS 5,287,836 * 2/1994 Shimasaki et al. ..... 123/406.2
5,771,688 * 6/1998 Hasegawa et al. ..... 60/276
6,164,125 * 12/2000 Kawase et al. ..... 73/118.1

FOREIGN PATENT DOCUMENTS

1033486 * 6/2000 (EP) ..... F02D/41/14
8-271475 10/1996 (JP) .
9-292364 11/1997 (JP) .

* cited by examiner

*Primary Examiner*—Henry C. Yuen
*Assistant Examiner*—Hieu T. Vo
(74) *Attorney, Agent, or Firm*—Kenyon & Kenyon

(57) ABSTRACT

A control device detects a characteristic change of an air-fuel ratio sensor indicative of deterioration of the air-fuel ratio sensor. The control device determines deterioration due to aging of the air-fuel ratio sensor accurately and calculates an air-fuel ratio from the air-fuel ratio sensor highly accurately. Then, the control device detects a current proportional to the concentration of oxygen in the detected gas from a sensor element by applying a voltage to the sensor element of the air-fuel ratio sensor. By applying AC voltages at high and low frequencies to the element, an AC impedance is detected. The temperature of the element is controlled to a target temperature according to the high frequency impedance and a characteristic change of the element is detected in accordance with the low frequency impedance.

12 Claims, 39 Drawing Sheets

| $Zac_2$ [Ω] | 5 | 10 | 15 | 20 | 25 | 30 |
|---|---|---|---|---|---|---|
| Zactggk [Ω] | -1 | 0 | 0 | 0 | 1 | 2 |

| ZacHTG [Ω] | 10 | 20 | 30 | 40 | 50 |
|---|---|---|---|---|---|
| ZacLINIT [Ω] | 15 | 30 | 45 | 60 | 75 |

| Zactg [Ω] | 20 | 25 | 30 | 35 | 40 |
|---|---|---|---|---|---|
| Zacact [Ω] | 23 | 28 | 32 | 37 | 42 |

| AIR AMOUNT ga (g/sec) | 20 | 40 | 60 | 80 | 100 | 120 |
|---|---|---|---|---|---|---|
| Zac2 CORRECTION RATE kgaz (%) | 0 | 3 | 5 | 7 | 10 | 14 |

FIG. 32

| Zac1 \ Zac2 | 70 | 75 | 80 | 90 | 100 | 120 | 140 | 160 | 180 | 200 |
|---|---|---|---|---|---|---|---|---|---|---|
| 60 | 12 | 14.6 | 18 | 18 | 18 | 18 | 18 | 18 | 18 | 18 |
| 80 | 12 | 12 | 13 | 14.6 | 16 | 18 | 18 | 18 | 18 | 18 |
| 100 | 12 | 12 | 12 | 12 | 13 | 14.6 | 16 | 18 | 18 | 18 |
| 120 | 12 | 12 | 12 | 12 | 12 | 12 | 13 | 14.6 | 16 | 18 |
| 150 | 12 | 12 | 12 | 12 | 12 | 12 | 12 | 13 | 14.6 | 18 |

| Zactg[Ω] | 10 | 20 | 30 | 40 | 50 |
|---|---|---|---|---|---|
| afvmin[Ω] | 15 | 25 | 35 | 50 | 60 |

| Zactg[Ω] | 10 | 20 | 30 | 40 | 50 |
|---|---|---|---|---|---|
| afvmax[Ω] | 25 | 45 | 70 | 90 | 110 |

FIG. 43

| Zactg[Ω] | 10 | 20 | 30 | 40 | 50 |
|---|---|---|---|---|---|
| afrmin[Ω] | 12 | 23 | 34 | 48 | 58 |

| Zactg[Ω] | 10 | 20 | 30 | 40 | 50 |
|---|---|---|---|---|---|
| afrmax[Ω] | 30 | 60 | 90 | 120 | 150 |

CONTROL DEVICE FOR AN AIR-FUEL RATIO SENSOR

INCORPORATION BY REFERENCE

The disclosure of Japanese Patent Application No. HEI 11-57322 filed on Mar. 4, 1999 including the specification, drawings and abstract thereof is incorporated herein by reference in its entirety.

BACKGROUND OF THE INVENTION

1. Field of the Invention

The present invention relates to a control device for an air-fuel ratio sensor, and more particularly to a control device for an air-fuel ratio sensor which detects an impedance of an air-fuel ratio sensor element, such as an oxygen concentration detecting element, for accurately and quickly detecting an air-fuel ratio of exhaust gas from an internal combustion engine, the control device detecting a failure and activating a condition of the air-fuel ratio sensor based on the detected impedance and accurately calculating an air-fuel ratio from an output of the air-fuel ratio sensor.

2. Description of the Related Art

In recent years, air-fuel ratio control has been performed using an air-fuel ratio sensor and catalyst disposed in an emission system of the engine with feedback control being carried out so that an air-fuel ratio detected by the air-fuel ratio sensor becomes a target air-fuel ratio, for example, a stoichiometric air-fuel ratio, in order to maximize purification of harmful components (hydrocarbon HC, carbon monoxide CO, nitrogen oxides $No_x$ and the like) in exhaust gas via catalysts. An oxygen concentration detecting element of limit current type outputting a limit current in corresponding to the concentration of oxygen contained in the exhaust gas emitted from the engine has been used for this purpose. The limit current type oxygen concentration detecting element has been used for detecting an air-fuel ratio of exhaust gas from the engine linearly according to the concentration of oxygen and is useful for improving air-fuel ratio control accuracy and for controlling an exhaust gas air-fuel ratio of the engine to a target air-fuel ratio in an interval from a rich or theoretical air-fuel ratio (stoichiometric) to lean.

The above-mentioned oxygen concentration detecting element must be maintained in an activating condition to keep the preserve the accuracy of the detected air-fuel ratio. Usually, by energizing a heater provided in the element after the engine is started, the element is heated and activated early. To keep that activating state, the electric power supplied to the heater is controlled.

FIG. 45 is a diagram showing a correlation between the temperature of the oxygen concentration detecting element and an impedance thereof. There is a correlation shown by a solid line in FIG. 45, that is, that the impedance of the element is attenuated with a rise of the element temperature. Paying attention to this relation, in the above described control of energization of the heater, feedback control is carried out so that an impedance of the element is detected to introduce an element temperature and that element temperature is adjusted to a desired activation temperature, for example, 700° C. For example, when the impedance Zac of the element corresponding to the initial control element temperature 700° C. is 30 Ω or more (Zac≧30) as indicated by the solid line of FIG. 45 between the temperature of the oxygen concentration detecting element (hereinafter simply referred to as an element), that is, the element temperature is 700° C. or less, electric power is supplied to the heater. If the Zac is smaller than 30 Ω (Zac<30), or the element temperature exceeds 700° C., the supply of electric power to the heater is released so as to maintain the temperature of the element more than 700° C. thereby keeping the activating condition of the element. Further, when electric power is supplied to the heater, duty control is carried out so that an electric power amount necessary for eliminating a deviation (Zac−30) between an element impedance and its target value is obtained and that electric power amount is supplied.

For example, according to a related technology disclosed in Japanese Patent Application Laid-Open No. HEI 9-292364, when an impedance of the oxygen concentration detecting element is detected, an AC voltage of a preferred frequency is applied to detect an element temperature so as to detect the impedance. By applying the voltage of that frequency, a resistance of an electrolyte portion of the element can be measured. Because the resistance of the electrolyte portion does not change largely by aging, likewise the element impedance does not change largely. Therefore, it can be considered that the relation between the element temperature and impedance indicated by the bold line of FIG. 45 is substantially maintained unchanged irrespective of aging.

However, after the oxygen concentration detecting element has aged, a correlation between the element temperature and impedance is as shown by the dotted line of FIG. 45.

Here, a structure of the air-fuel ratio sensor, equivalent circuit and impedance characteristic will be described.

FIG. 46A is a sectional structure diagram of the air-fuel ratio sensor element and FIG. 46B is a partially enlarged diagram of the electrolyte portion.

FIG. 47 is a diagram showing an equivalent circuit of the air-fuel ratio sensor element. In FIG. 47, R1 denotes a bulk resistance of the electrolyte composed of, for example, zirconia (grain portion in FIG. 46); R2 denotes a granular resistance of the electrolyte (grain boundary portion of FIG. 46); R3 denotes an interface resistance of an electrode composed of, for example, platinum; C2 denotes a granular capacitive component of the electrolyte (any grain bound part in FIG. 46); C3 denotes a capacitive component of the electrode interface and Z(W) denotes an impedance (Warburg impedance) generated when the interface concentration changes periodically as electric polarization is carried out by the AC current.

FIG. 48 is a diagram showing an impedance characteristic of the air-fuel ratio sensor element. The abscissa indicates a real part Z' of the impedance Z and the ordinate indicates an imaginary part Z". An impedance Z of the air-fuel ratio sensor element is expressed by Z=Z'+jZ". From FIG. 48, it is evident that the electrode interface resistance R3 converges to 0 as the frequency approaches 1 to 10 kHz. Further, a curve indicated by a dotted line indicates an impedance which changes when the air-fuel ratio sensor element is deteriorated. From a portion of the impedance characteristic indicated by this dotted line, it is evident that particularly R3 changes by aging. When the oxygen concentration of gas detected by the air-fuel ratio sensor element changes rapidly also, the impedance characteristic changes as indicated by the dotted line.

FIG. 49 is a diagram showing a relation between the frequency of AC voltage applied to the air-fuel ratio sensor element and the element impedance. FIG. 49 is obtained by converting the axis of abscissa of FIG. 48 to frequency f and the axis of ordinate to impedance Zac. From FIG. 48, it is evident that the impedance Zac converges to a predetermined value (R1+R2) in 1–around 10 kHz–10 MHz in frequency and the impedance Zac decreases on a higher frequency than 10 MHz so that it converges to R1. Therefore, to detect the impedance Zac in a stabilized state, it is evident that the near 1–around 10 kHz–around 10 MHz in which the Zac is constant regardless of the frequency is desired. Further, the curve indicated by the dotted line indicates an impedance when an AC voltage of a measurable low frequency (1 kHz or less) is applied to the R3 which changes by aging. From the low frequency impedance, the degree of the deterioration of the air-fuel ratio sensor element is determined.

As indicated by the dotted line of FIG. 45, the correlation between the temperature of the oxygen concentration detecting element which is an air-fuel ratio sensor element and an impedance of 1–around 10 kHz–10 MHz changes largely after the element is deteriorated as compared to when it is new.

However, according to Japanese Patent Application Laid-Open No. HEI 9-292364, because only a portion corresponding to a resistance R1+R2 of the air-fuel ratio sensor is measured, the characteristic change of the air-fuel ration sensor element cannot be grasped. Therefore, if the control on energization of the heater is continued with the element impedance Zac as the element temperature control target value maintained at 30 Ω, the control element temperature after the element is deteriorated increases gradually, so that, for example, it is set up to 800° C. Therefore, there is a problem that the element is over heated so that the deterioration is accelerated, thereby the service life thereof being reduced.

When the AC voltage of the low frequency of 1–around 10 kHz is applied to the air-fuel ratio sensor as shown in FIGS. 48, 49, a detected low frequency impedance changes largely after the element is deteriorated as compared to when the element is new.

However, according to Japanese Patent Application Laid-Open No. HEI 9-292364, because only the portion corresponding to the resistance R1+R2 of the air-fuel ratio sensor element is measured, the characteristic change of the air-fuel ratio sensor element cannot be grasped. Therefore, the element temperature or element characteristic changes so that calculation of the air-fuel ratio from the output of the air-fuel ratio sensor becomes inaccurate, thereby worsening emission from the engine. Alternatively, because the failure of the air-fuel ratio sensor or activating condition is determined based on an element impedance detected when the element temperature or element characteristic is changing, there is produced a problem that accurate determination of these factors is disabled.

SUMMARY OF THE INVENTION

Accordingly, the present invention is accomplished to solve these problems, and therefore, an object of the invention is to provide a control device of the air-fuel ratio sensor that detects an air-fuel ratio from the output value of the air-fuel ratio sensor with high accuracy and determining a failure or activating condition of the air-fuel ratio sensor accurately, by detecting a characteristic change of the air-fuel ratio sensor element accurately.

Another object of the invention is to provide a control device of the air-fuel ratio sensor that detects the air-fuel ratio with high accuracy from the output value of the air-fuel ratio sensor by maintaining the output characteristic of the air-fuel ratio sensor at a predetermined level such that the output characteristic of the air-fuel ratio sensor of the present invention is not affected by the change in lapse.

To achieve the above object, according to an aspect of the present invention, there is provided an air-fuel ratio sensor control device that detects a current corresponding to the concentration of oxygen gas in a detected gas from an oxygen concentration detecting element by applying a voltage to the oxygen concentration detecting element, including an impedance detecting device, a temperature adjusting device and a characteristic change detecting device. The impedance detecting device detects an AC impedance of the oxygen concentration detecting element corresponding to each of the plural frequencies by applying AC voltages at plural frequencies to the oxygen concentration detecting element. The temperature adjusting device adjusts the temperature of the oxygen concentration detecting element based on the first impedance at a high frequency side of the detected AC impedance. The characteristic change detecting device detects a characteristic change of the oxygen concentration detecting element based on a second impedance of a low frequency side of the detected AC impedance.

With the above structure, the characteristic change of the sensor element corresponding to deterioration of the air-fuel ratio sensor element can be detected accurately.

According to the above aspect, the characteristic change detecting device may detect a failure of the oxygen concentration detecting element.

Further, the characteristic change detecting device detects a failure of the oxygen concentration detecting element in accordance with the first impedance.

The characteristic change detecting device may change an output value of the oxygen concentration detecting element.

The characteristic change detecting device may change the output value of the oxygen concentration detecting element in accordance with the second impedance.

The characteristic change detecting device may change the output value of the oxygen concentration detecting element based on an initial value of the second impedance and a change amount from the initial value.

According to the above aspect of the invention, the temperature adjusting device may energize a heater provided in the oxygen concentration detecting element so as to heat the oxygen concentration detecting element based on the first impedance and a target temperature of the oxygen concentration detecting device.

The temperature adjusting device may change the target temperature in accordance with the second impedance.

According to the above aspect of the invention, the air-fuel ratio sensor control device may further include an air-fuel ratio determining device that determines the air-fuel ratio in accordance with the second impedance when the temperature of the oxygen concentration detecting element is within a first temperature range (for example, 500° C. or more, less than 700° C.), and determines the air-fuel ratio in accordance with the first impedance when the oxygen concentration detecting element is within a second temperature range which is higher than the first temperature range.

As a result, the output signal of the air-fuel ratio sensor can be used for air-fuel ratio feedback control even at low temperatures before the air-fuel ratio sensor element is activated.

Further, the air-fuel ratio sensor control device may further including an air-fuel ratio control device that controls an air-fuel ratio using an output value of the oxygen concentration detecting element by feedbacking the air-fuel ratio determined by the air-fuel ratio determining device, in which an air-fuel ratio feedback control gain of the air-fuel ratio control device in the first temperature range is lower than an air-fuel ratio feedback control gain of the air-fuel ratio control device in the second temperature range.

As a result, the air-fuel ratio feedback control gain is selected depending on the activation state of the air-fuel ratio sensor so that the air-fuel ratio feedback control is carried out depending on activation/non-activation state of the air-fuel ratio sensor element.

BRIEF DESCRIPTION OF THE DRAWINGS

FIG. 32 is a map for calculating an air-fuel ratio from a two-dimensional map of the high frequency impedance and low frequency impedance;

FIG. 43 is a map for calculating a lower limit value of the average of low frequency impedance allowing response deterioration of the air-fuel ratio sensor from an element temperature control target value;

DESCRIPTION OF THE PREFERRED EMBODIMENTS

Hereinafter, the embodiments of the present invention will be described in detail with reference to the accompanying drawings.

Figure 1:
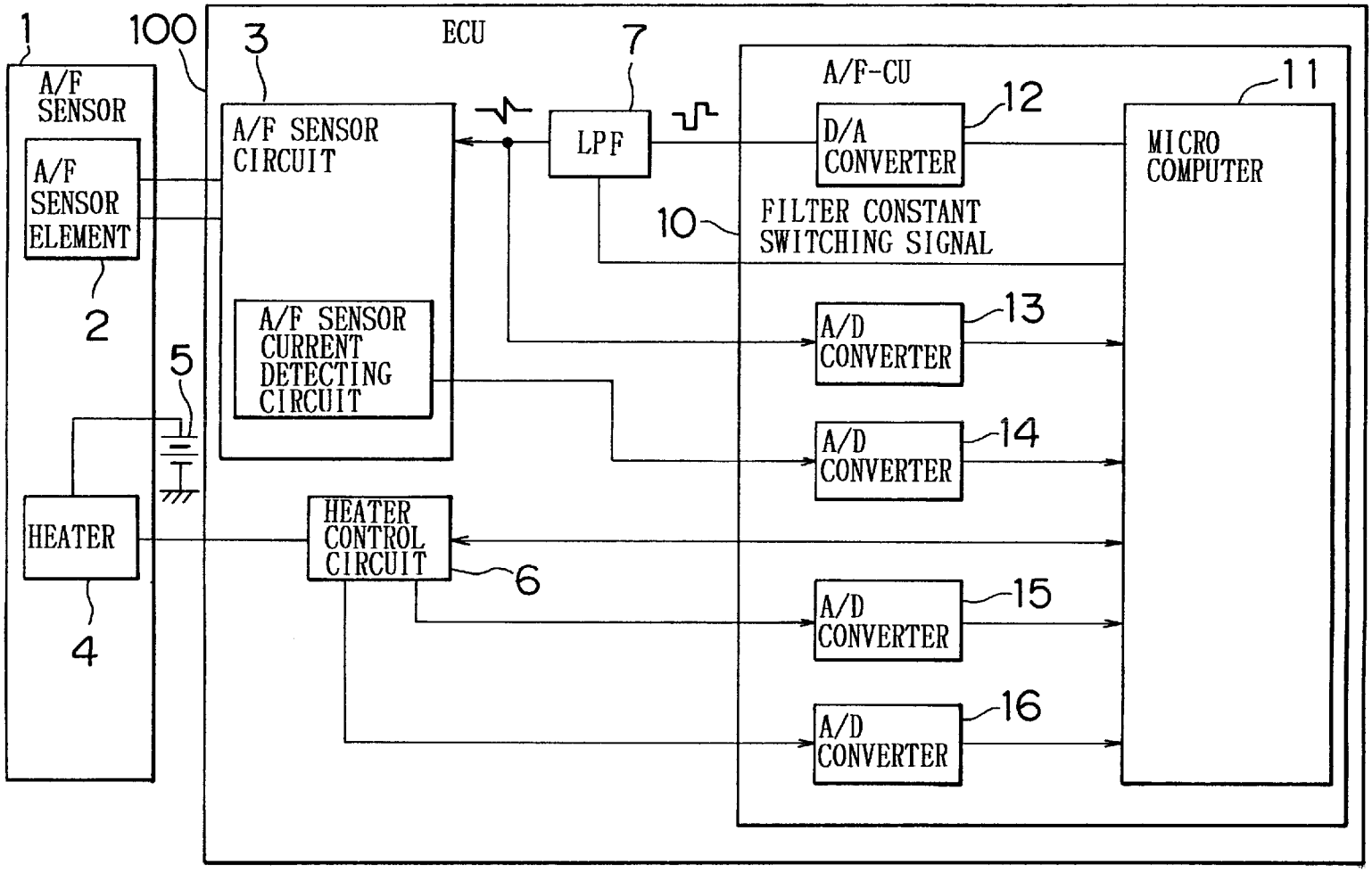
FIG. 1 is a schematic structure diagram of a control device for an air-fuel ratio sensor of the present invention.

FIG. 1 is a schematic structure diagram of an embodiment of the air-fuel ratio sensor control device of the present invention. An air-fuel ratio sensor (A/F sensor) 1 disposed in an exhaust gas passage of an internal combustion engine (not shown) for detecting an exhaust gas air-fuel ratio is composed of an air-fuel ratio sensor element 2 (hereinafter referred to as a sensor element 2) and a heater 4. A voltage is applied from the air-fuel ratio sensor circuit 3 (hereinafter referred to as a sensor circuit 3) to the sensor element 2. Electric power is supplied to a heater 4 from a battery 5 under the control of a heater control circuit 6. The sensor circuit 3 receives an analog applied voltage from an air-fuel ratio control unit (A/F-CU) composed of a micro computer via a low pass filter (LPF) 7 and applies the voltage to the sensor element 2.

Figure 2:
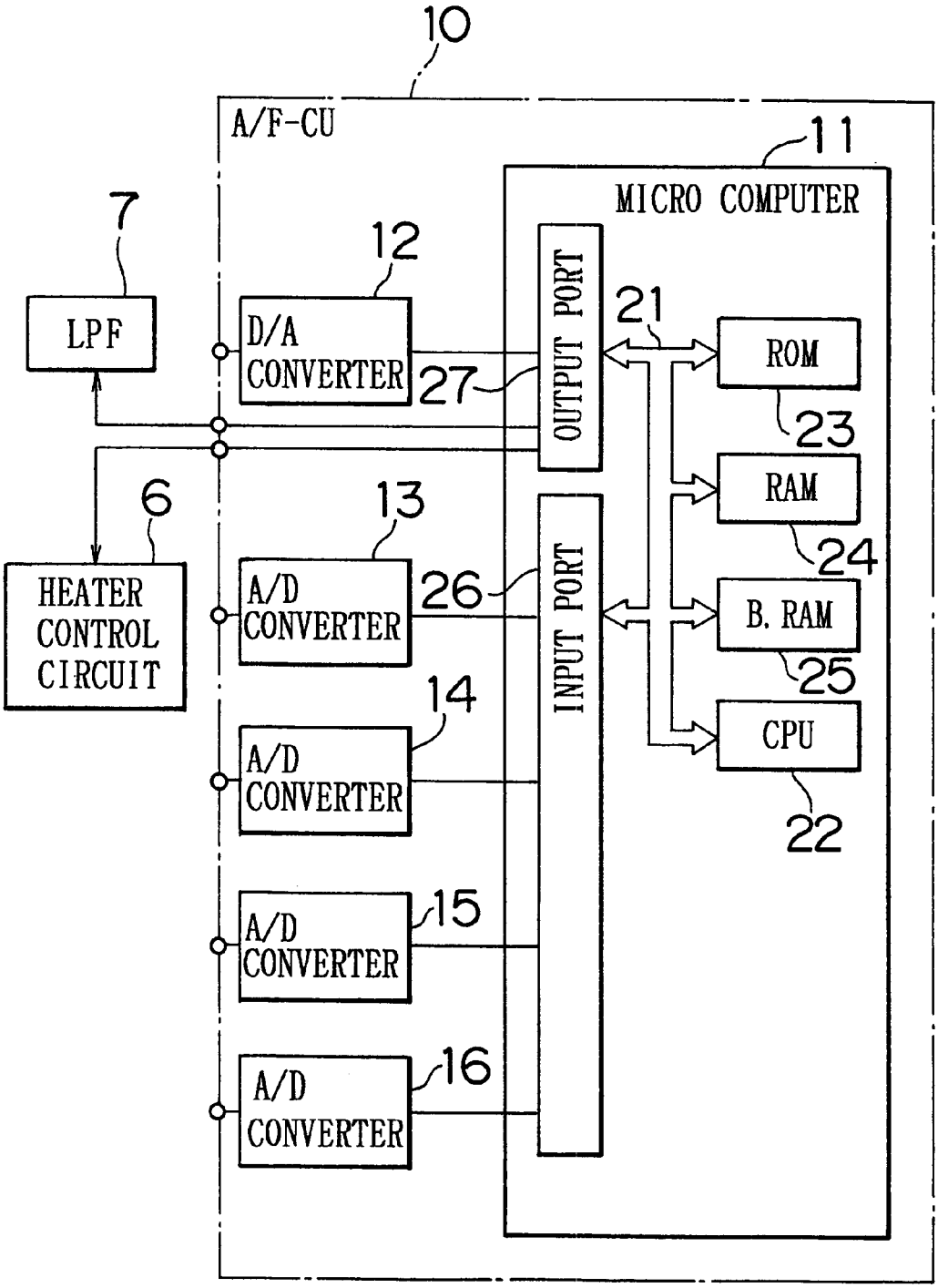
FIG. 2 is an explanatory diagram of an air-fuel ratio control device of FIG. 1.

The A/F-CU 10 partially constitutes an electronic control unit (ECU) 100 together with the sensor circuit 3, the heater control circuit 6 and the LPF 7. As shown in FIG. 2, the AF-CU 10 includes a micro computer 11, a D/A converter 12 and an A/D converters 13–16. The micro computer 11 includes CPU 22, ROM 23, RAM 24, B.RAM 25, input port 26 and output port 27 connected with one another via a bi-directional bus 21 so as to control the air-fuel ratio sensor of the present invention as described later. The D/A converter 12 is connected to the output port 27 so as to convert digital data computed by the CPU 22 to an analog voltage. The A/D converters 13, 14 are connected to the input port 26 so as to convert the analog voltage applied to the sensor circuit 3 and the analog voltage proportional to a current detected by the A/F sensor current detecting circuit in the sensor circuit 3 to digital data, respectively. Likewise, the A/D converters 15, 16 convert voltage and current of the heater 4 into digital data via the heater control circuit 6. The CPU 22 reads these digital data as voltage and current of the sensor element 2 and as voltage and current of the heater 4. A signal for switching a filter constant of the LPF 7 and DUTY signal for controlling quantity of power supplied to the heater 4 are respectively output from the output port 27 to the LPF 7 and the heater control circuit 6, respectively.

Figure 3:
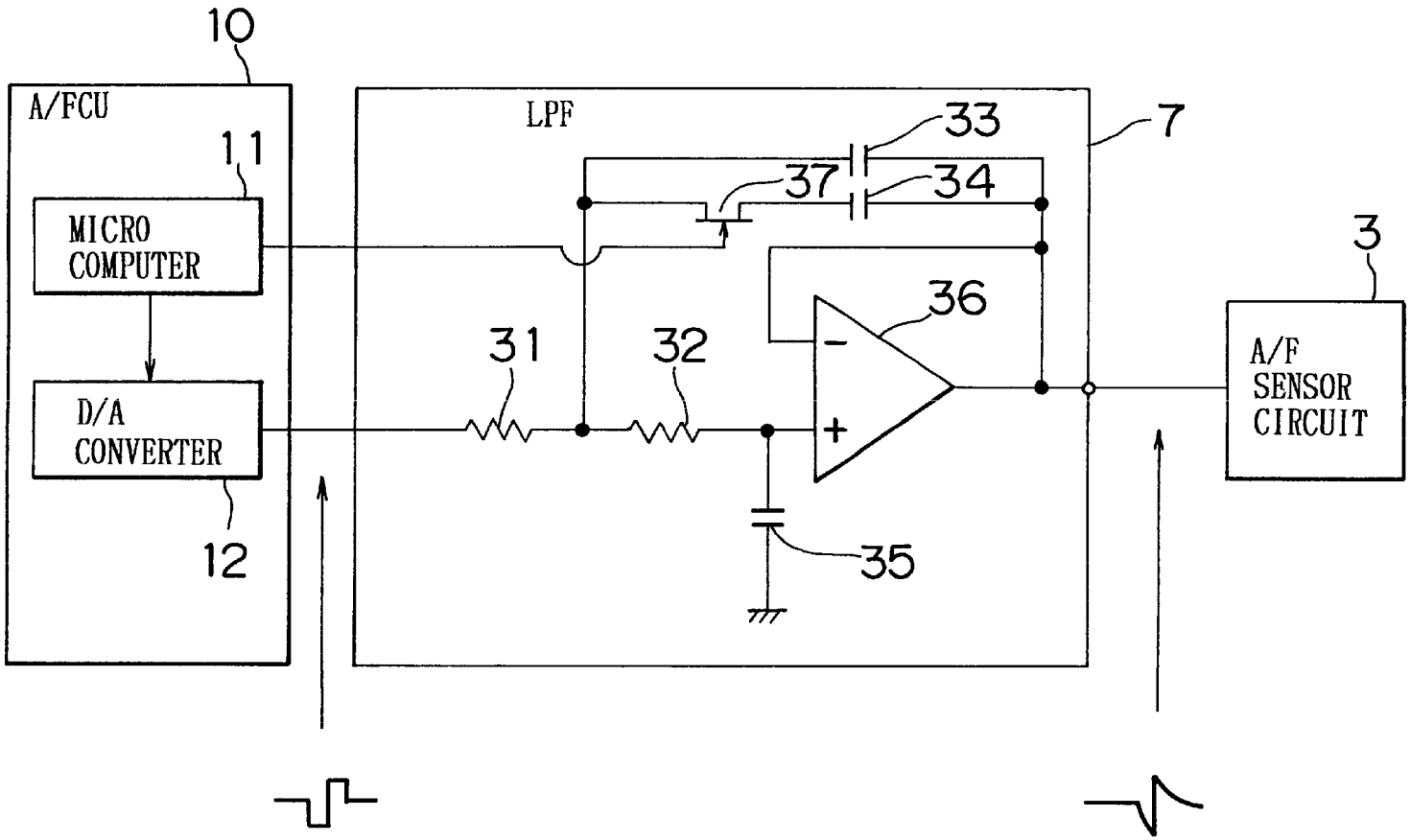
FIG. 3 is an explanatory diagram of LPF of FIG. 1.

As shown in FIG. 3, the LPF 7 is composed of resistors 31, 32, capacitors 33, 34, 35, an operational amplifier (OP amplifier) 36 and a field effect transistor (FET) 37 exhibiting a function for switching the filter constant (time constant defined by values of the resistors 31, 32 and capacity of the capacitors 33–35). An ON signal is sent to the FET 37 from the micro computer 11 at low frequency and an OFF signal is sent at high frequency. The filter constant of the LPF 7 is switched so that its time constant decreases when the first AC voltage (high frequency voltage) is applied and the time constant increases when the second AC voltage (low frequency voltage) is applied.

In order to cause the A/F-CU 10 to carry out air-fuel ratio control, the sensor element 2 needs to be activated. For this reason, when starting the engine, the A/F-CU 10 supplies electric power to the heater 4 incorporated in the sensor element 2 from the battery 5 so as to energize the heater 4 thereby activating the sensor 2 at an earlier stage. After the sensor 2 is activated, electric power is supplied to the heater 4 to keep the activation state.

The resistance of the sensor element 2 that depends on a temperature of the sensor element 2 is damped as the increase in the temperature of the sensor element. Accordingly electric power is supplied to the heater 4 so that the resistance of the sensor element 2 measures the value (for example, 30 Ω) corresponding to the temperature (for example, 700° C.) for maintaining the activating state of the sensor element 2. As a result, the temperature of the sensor element 2 is maintained at the target temperature. The A/F-CU 10 receives an analog voltage corresponding to the voltage and current of the heater 4 from the heater control circuit 6 for heating the sensor element 2, through the A/D converter provided therein and converts it into digital data. The digital data are used for the processing which will be described later. For example, a resistance value of the heater 4 is computed and then electric power is supplied to the heater 4 based on the resistance value corresponding to an operating state of the engine and the temperature of the heater 4 is controlled to prevent an over temperature of the heater 4.

Figure 4A:
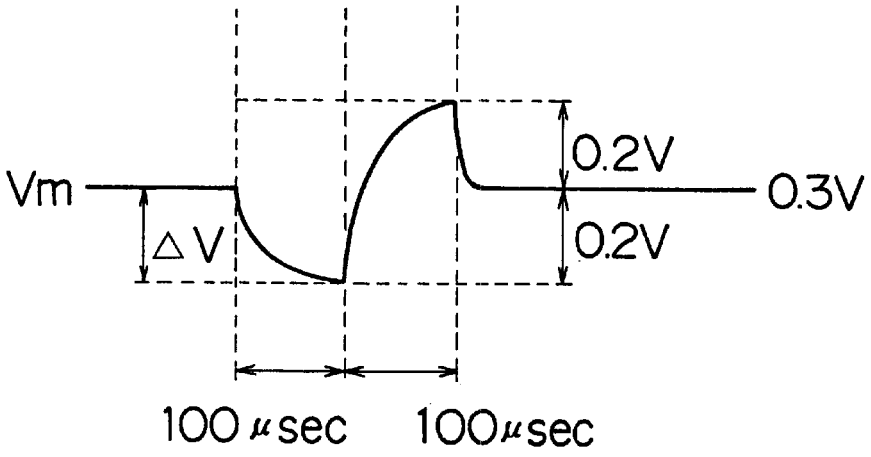
FIG. 4A is a diagram showing a waveform of input voltage applied to the air-fuel ratio sensor.
Figure 4B:
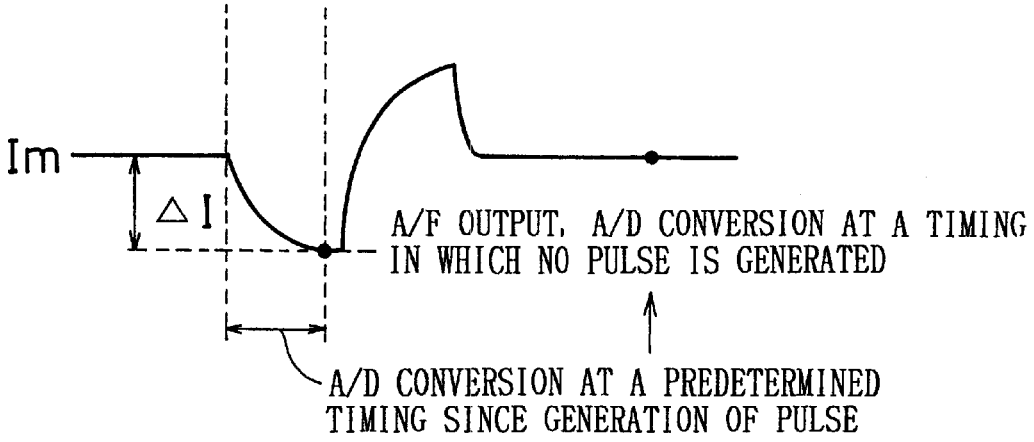
FIG. 4B is a diagram showing a waveform of output current detected by the air-fuel ratio sensor.

FIGS. 4A, 4B are diagrams showing input/output signals of the air-fuel ratio sensor. FIG. 4A shows the waveform of an input voltage to be applied to the air-fuel ratio sensor. As the input voltage Vm to be applied to the air-fuel ratio sensor, DC voltage of 0.3 V is applied constantly. To measure an impedance of the sensor element, the first frequency pulse voltage at ±0.2V is applied to the air-fuel ratio sensor so that it is superimposed on DC voltage at 0.3 V by executing the routine described later.

Figure 48:
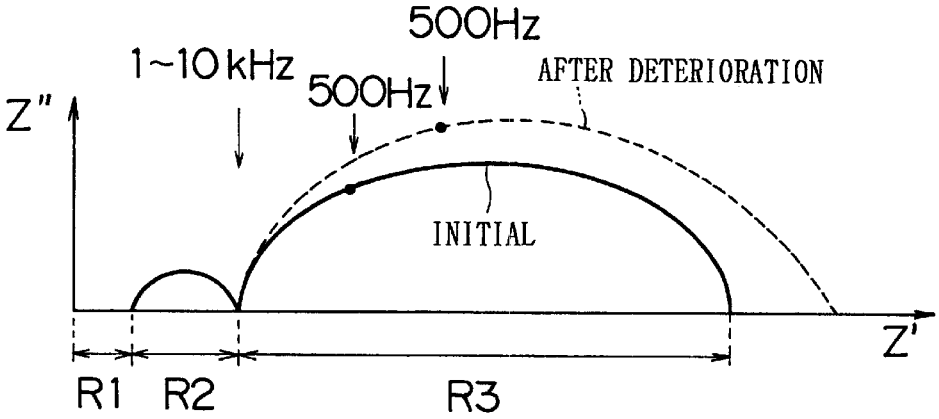
FIG. 48 is a diagram showing impedance characteristic of the air-fuel ratio sensor element.
Figure 49:
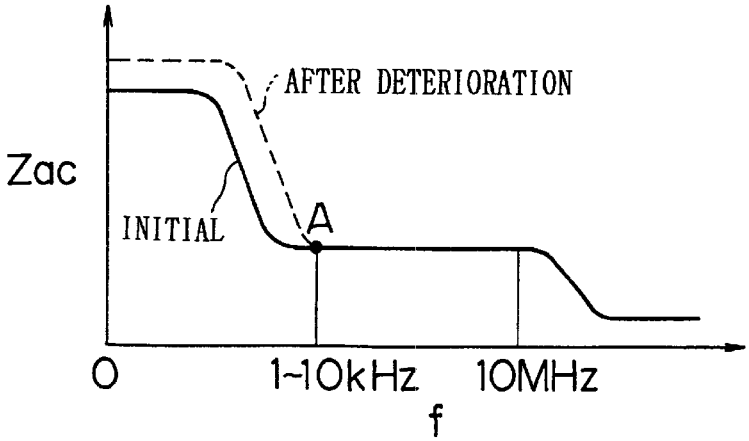
FIG. 49 is a diagram showing a relation between the frequency of AC applied voltage to the air-fuel ratio sensor element and element impedance.

FIG. 4B shows a waveform of an output current detected from the air-fuel ratio sensor. An output current Im detected from the air-fuel ratio sensor indicates a value corresponding to an oxygen concentration of the exhaust gas to be measured when applying only DC voltage at 0.3 V to the air-fuel ratio sensor. However if a pulse voltage at ±0.2 V is superimposed on DC voltage at 0.3 V, which is applied to the air-fuel ratio sensor, the value just before the voltage application is changed. Changes in a voltage applied to the air-fuel ratio sensor and output current from the air-fuel ratio sensor at this time are detected so as to calculate an impedance of the sensor element. The impedance characteristic of the sensor element of this air-fuel ratio sensor is the same as those shown in FIGS. 48, 49.

Figure 5:
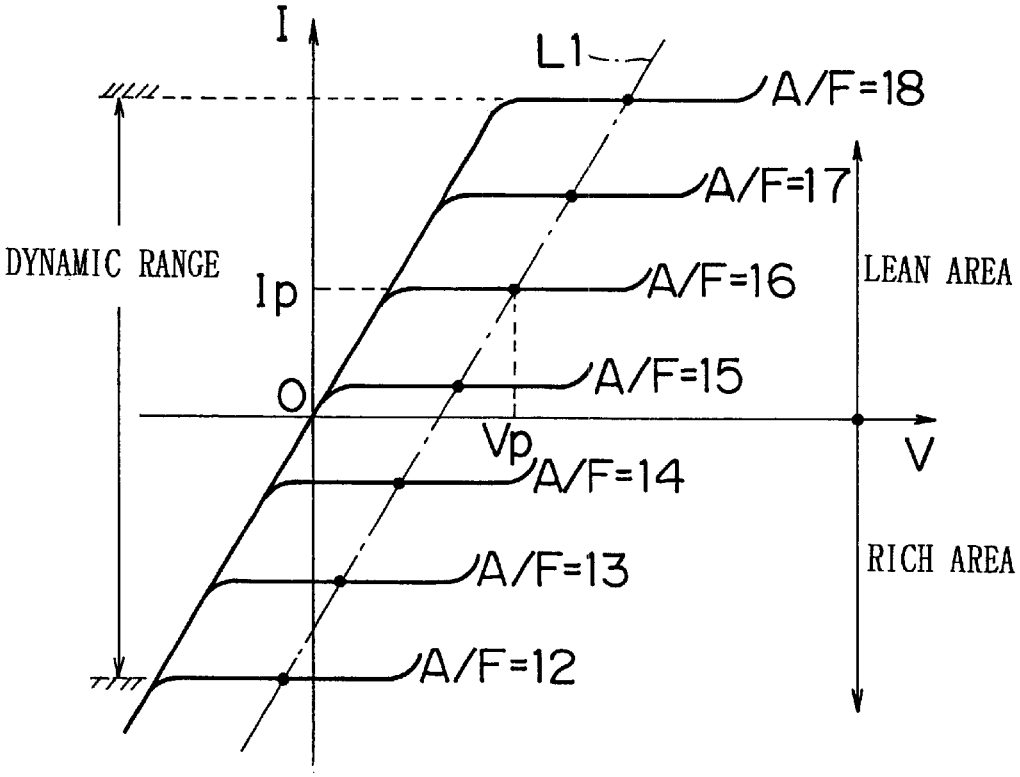
FIG. 5 is a diagram showing voltage-current characteristic of the air-fuel ratio sensor.

FIG. 5 is a diagram showing voltage-current characteristic of the air-fuel ratio sensor. The axis of abscissa indicates a voltage applied to the air-fuel ratio sensor (V) and the axis of ordinate indicates an output current of the air-fuel ratio sensor (I). As evident from FIG. 5, the applied voltage V is almost proportional to the output current I so that a current value changes to a positive side if the air-fuel ratio is lean and to a negative side if the air-fuel ratio is rich (see a characteristic line L1 indicated by a chain line in the same FIG. 5). That is, limit current increases as the air-fuel ratio goes to the lean side and the limit current decreases as the air-fuel ratio goes to the rich side. When the output current I is 0 mA, the air-fuel ratio becomes stoichiometric (about 14.5).

Figure 6:
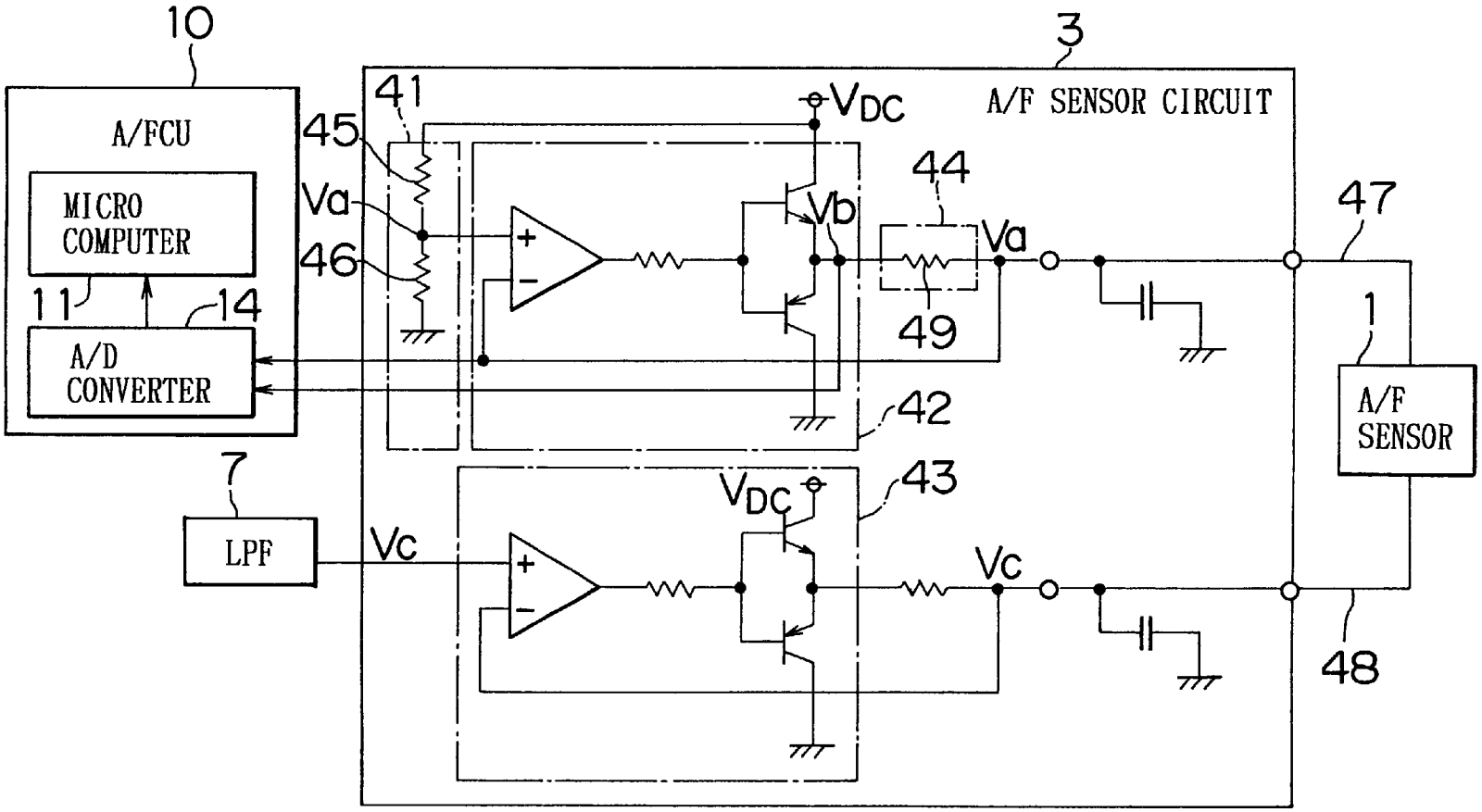
FIG. 6 is an explanatory diagram of an air-fuel ratio sensor circuit of FIG. 1.
Figure 7:
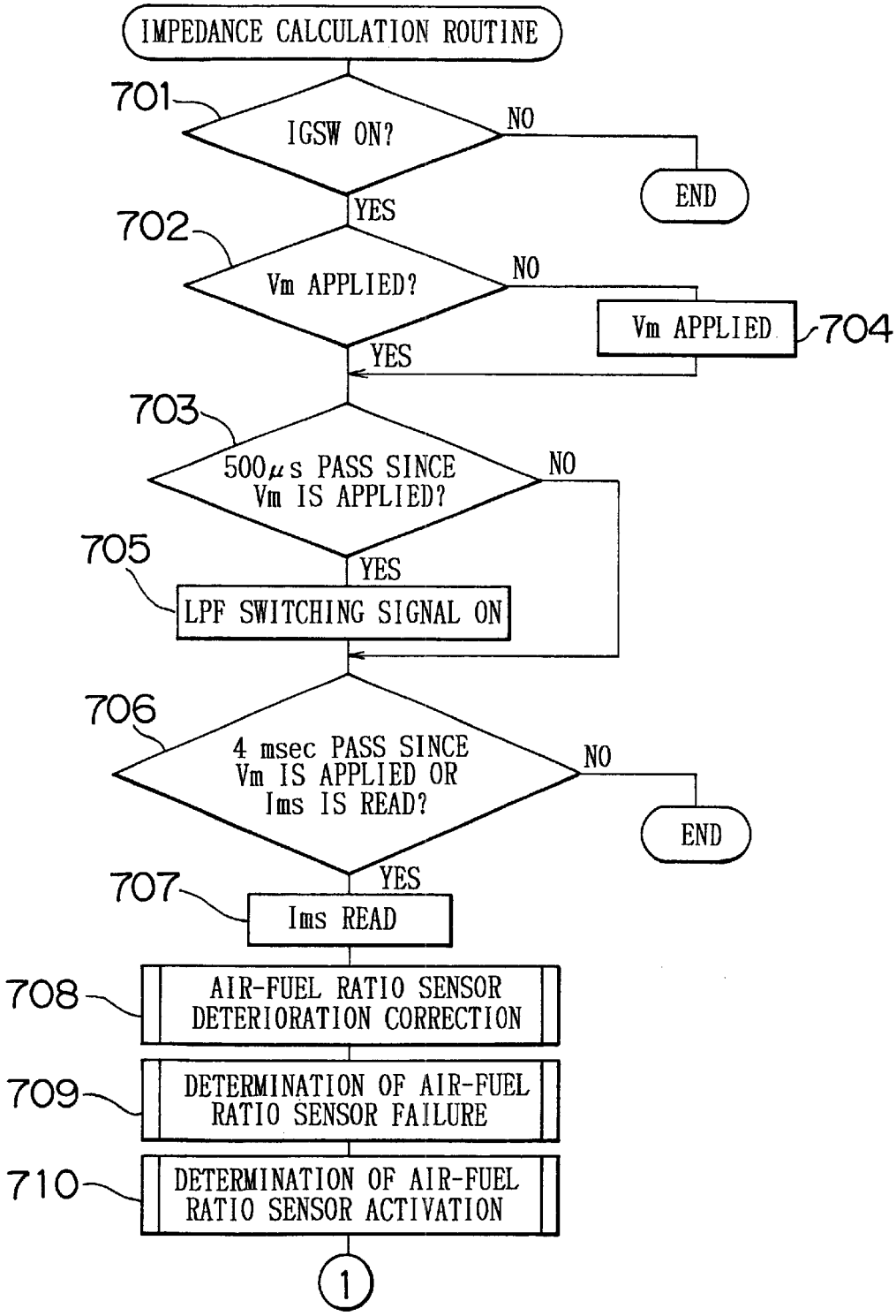
FIG. 7 is a flow chart of impedance calculation routine of a sensor element according to the first embodiment of the present invention.

FIG. 6 is an explanatory diagram of the sensor circuit 3. The sensor circuit 3 is formed of a reference voltage circuit 41, a first voltage supply circuit 42, a second voltage supply circuit 43 and a current detecting circuit 44. The reference voltage circuit 41 uses a voltage Va obtained by dividing a constant voltage $V_{DC}$ by resistors 45, 46, for example, for example, 0.6 V as the reference voltage. Each of the first voltage supply circuit 42 and the second voltage supply circuit 43 constitutes a voltage follower. The first voltage supply circuit 42 supplies the reference voltage Va to a terminal 47 of the A/F sensor 1. The second voltage supply circuit 43 is connected to the LPF 7 so as to supply an output voltage $V_c$ (0.3±0.2 V) to the other terminal of the A/F sensor 1. Although the output voltage $V_c$ of the LPF 7 is usually 0.3 V, when the element impedance of the A/F sensor 1 is measured by the micro computer 11, ±0.2 V is superimposed on 0.3 V and outputted. Thus, a voltage at 0.1 to 0.5 V is applied to the A/F sensor 1. The current detecting circuit 44 is composed of a resistor 49 so as to detect a current flowing through the A/F sensor 1 by reading a voltage between both ends (|Vb–Va|?) of the resistor 49 via the A/D converter 13.

Next, an impedance calculation routine for computing an impedance of the sensor element by the air-fuel ratio sensor control device according to the embodiment of the present invention shown in FIGS. 7–13 will be described in detail.

Figure 14:
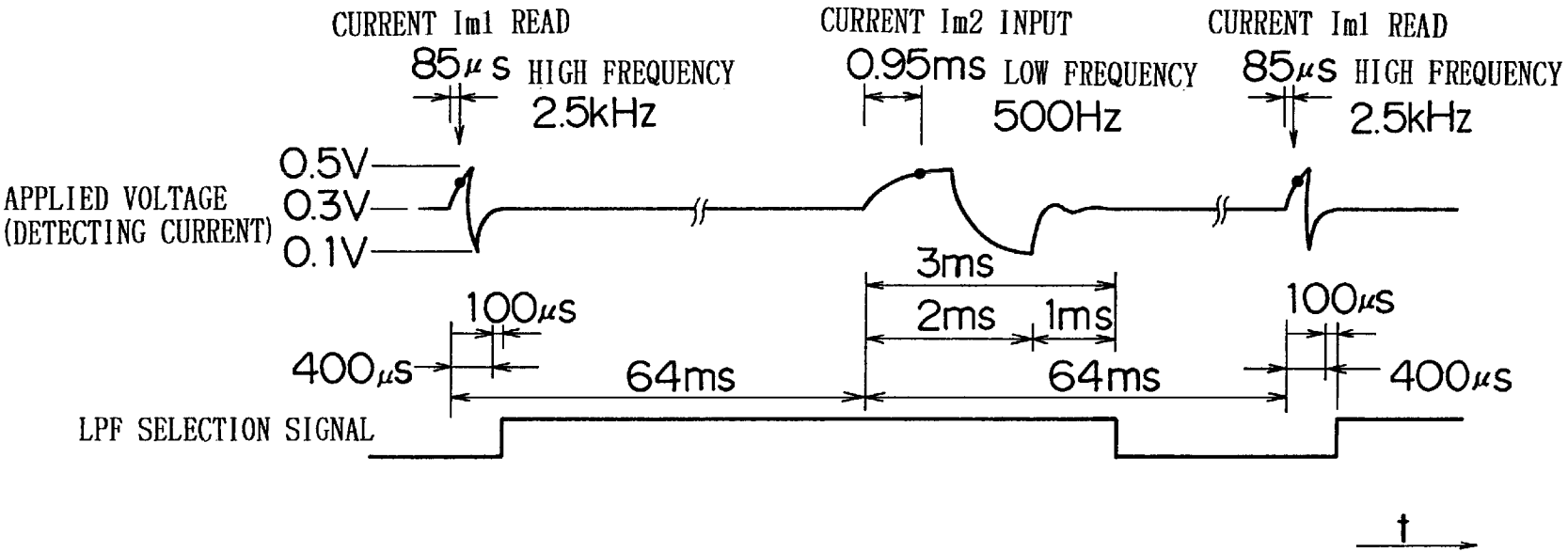
FIG. 14 is a time chart for explaining the impedance calculation routine of the sensor element according to the first embodiment of the present invention.

FIG. 14 is a time chart for explaining the impedance calculation routine for the sensor element. The axis of abscissa represents the time, where an upper level indicates a voltage applied to the sensor element 2 and a lower level indicates ON/OFF condition of the LPF selection signal for changing the setting of the filter constant of the LPF 7. A change in the current flowing through the sensor element 2 is substantially the same as the change in the applied voltage.

Calculation of the impedance of the sensor element 2 of this embodiment is carried out as follows.

Usually, a DC voltage at 0.3 V is applied between electrodes of the sensor element 2 and at every 128 msec, the first frequency, for example, a high frequency pulse at 2.5 kHz is applied to the sensor element 2. Each time when 64 msec passes after application of the high frequency pulse, the second frequency, for example, a low frequency at 500 Hz is applied to the sensor element 2. After application of the high frequency pulse, for example, after the elapse of 85 μs, a current Iml flowing through the sensor element 2 is detected and the first (high frequency) impedance Zacl is calculated according to a following formula based on an ΔVm(=0.3–0.1=0.2V) in the sensor element applied voltage and an increment ΔIm(=Iml–Ims) in the current.

$$Zacl=\Delta m/\Delta Im=0.2/(Iml-Ims)$$

where Ims is a limit current in the sensor element detected at every 4 msec.

After application of the low frequency pulse, for example, after the elapse of 0.95 msec, a current Im2 flowing through the sensor element 2 is detected and the second (low frequency) impedance Zac2 is calculated according to the following formula based on an increment ΔVm(=0.3–0.1=0.2 V) and an increment ΔIm(=Im2–Ims).

$$Zac2=\Delta Vm/\Delta Im=0.2/(Im2-Ims)$$

As for the ON/OFF timing, the LPF selection signal is turned ON after the high frequency pulse is applied, for example, after 500 μs passes. Then, the low frequency pulse is applied after 64 msec pass after application of the high frequency pulse, then after the elapse of 3 msec, the selection signal is turned OFF. During the time zone for applying the low frequency pulse including the cycle of 2 msec at the low frequency pulse and its convergent time of 1 msec, the filter constant is set to a large value.

The impedance calculation routine for the sensor element according to the time chart described above will be described in detail with reference to FIGS. 7 to 13.

First in step 701, it is determined whether an ignition switch IGSW (not shown) is ON or OFF. If the IGSW is ON, the process proceeds to step 702. If the IGSW is OFF, this routine is terminated. In step 702, it is determined whether or not a DC voltage at Vm=0.3 V is applied to the air-fuel ratio sensor 1. If YES, the process proceeds to step 703. If NO, the process proceeds to step 704 where a DC voltage at 0.3 V is applied to the air-fuel ratio sensor.

In step 703, it is determined whether or not 500 ms is elapsed after application of Vm. If YES, the process proceeds to step 705 where a selection signal for increasing the filter constant is output from the micro computer 11 to the LPF 7. If the determination result of step 705 is NO, the process proceeds to step 706.

In step 706, it is determined whether or not 4 msec is elapsed after applying the DC voltage of 0.3 V to the air-fuel ratio sensor 1 in step 704, or 4 msec is elapsed after reading the current Ims of the air-fuel ratio sensor in the previous processing period of this routine. This determination is achieved with, for example, a counter. If any one of those determination results is YES, the process proceeds to step 707. If both the determination results are NO, this routine is terminated. In step 707, the current Ims of the air-fuel ratio sensor is read. That is, the current Ims is read at every 4 msec.

In step 708, the process for deterioration correction of the air-fuel ratio sensor, which will be described later, is executed. In step 709, the process for failure determination of the air-fuel ratio sensor, which will be described later, is executed. In step 710, the process for activation determination of the air-fuel ratio sensor, which will be described later, is executed.

Figure 8:
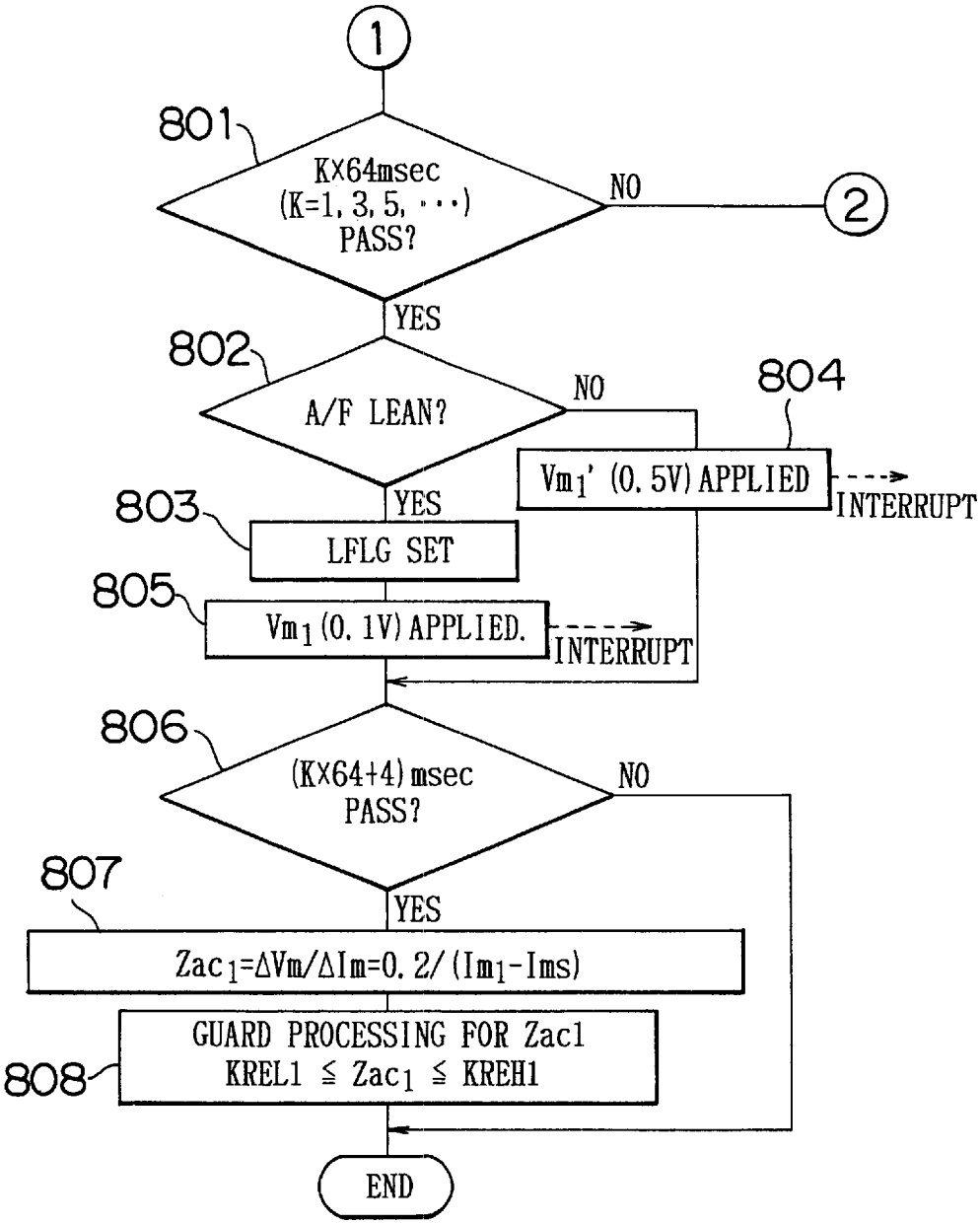
FIG. 8 is a flow chart of first frequency superimpose processing in the impedance calculation routine of the sensor element.
Figure 9:
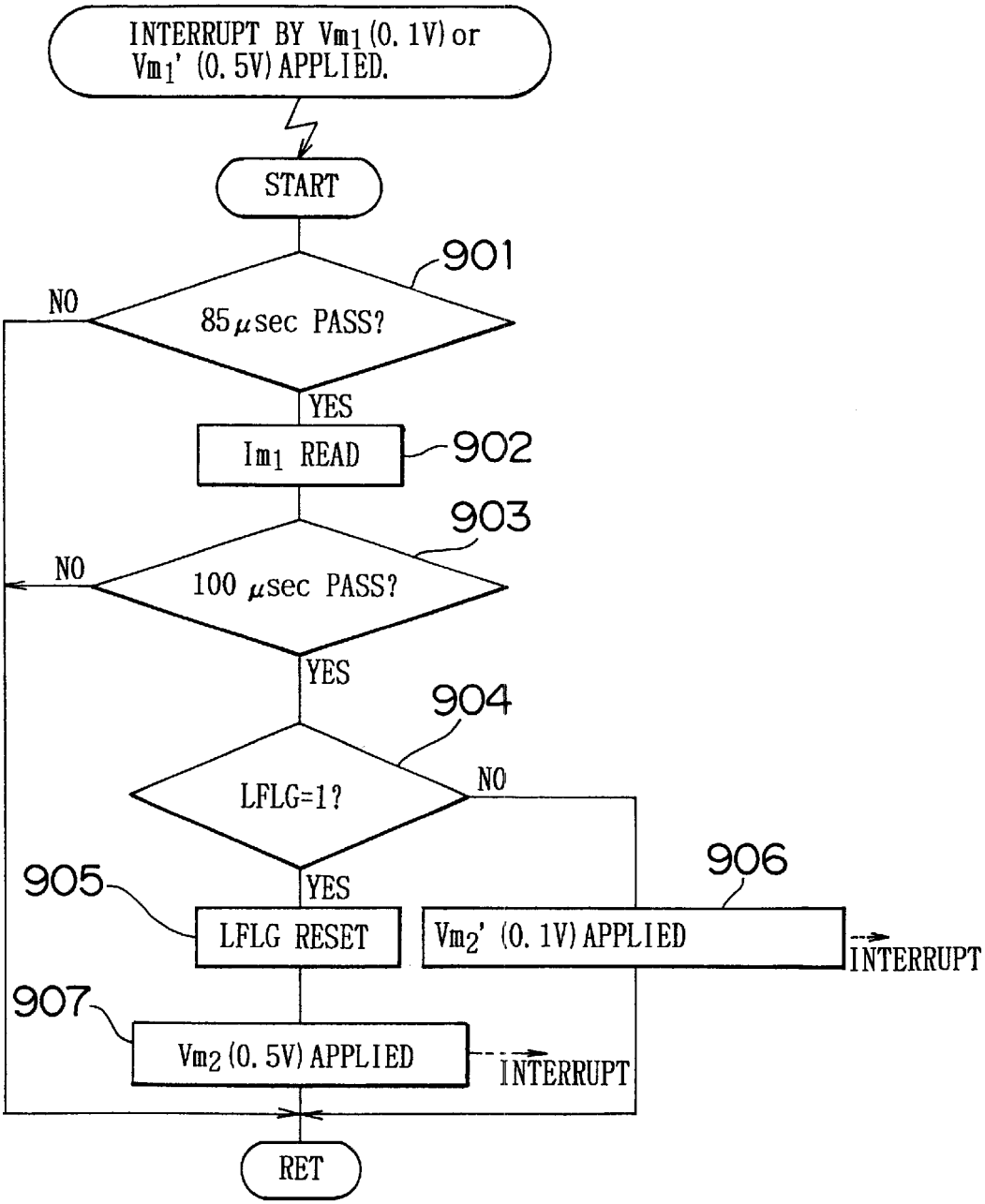
FIG. 9 is a flow chart of first interrupt processing routine to be executed in the first frequency superimpose processing.
Figure 10:
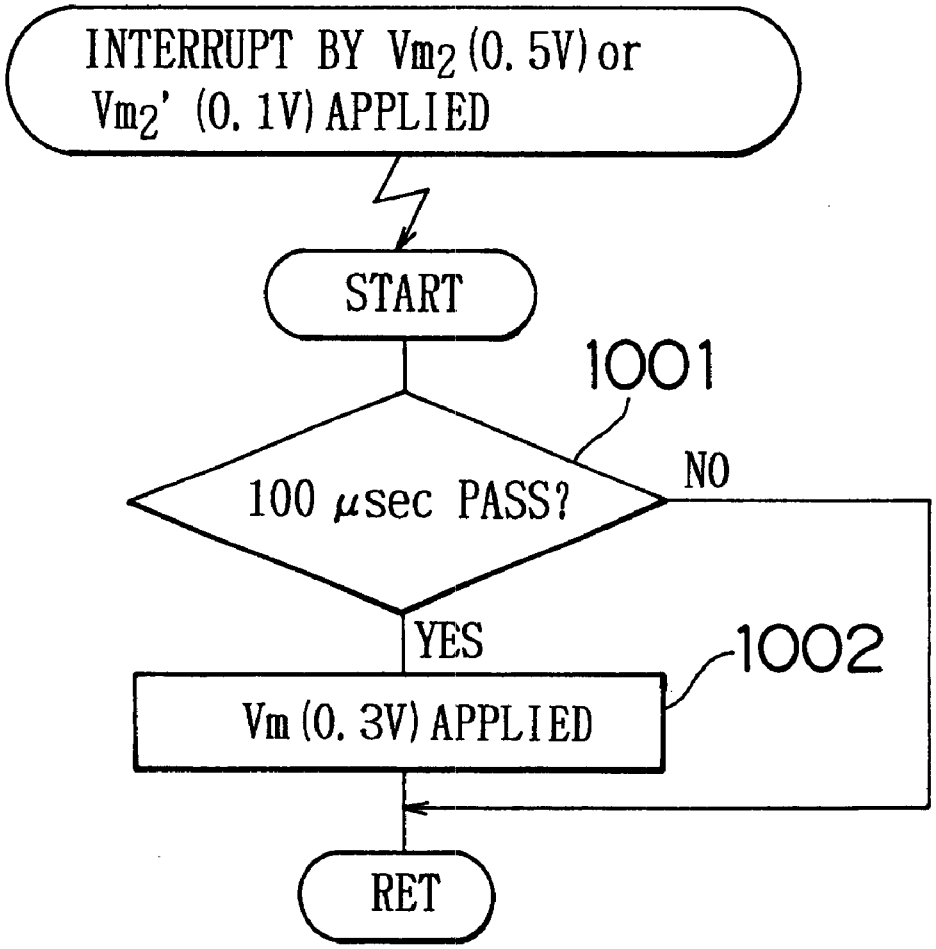
FIG. 10 is a flow chart of second interrupt processing to be executed during the first frequency superimpose processing.

FIGS. 8 to 10 are flow charts of the first frequency superimpose processing of this routine. Here, as the first frequency, for example, 5 kHz is used.

The first frequency superimpose processing concerns a processing for maintaining the output of the A/F sensor 1 within a dynamic range shown in FIG. 5 in order to enable to detect a limit current of the sensor element 2. Therefore, a voltage applied to the sensor element 2 is controlled in accordance with an air-fuel ratio of the exhaust gas discharged from the engine.

Figure 12:
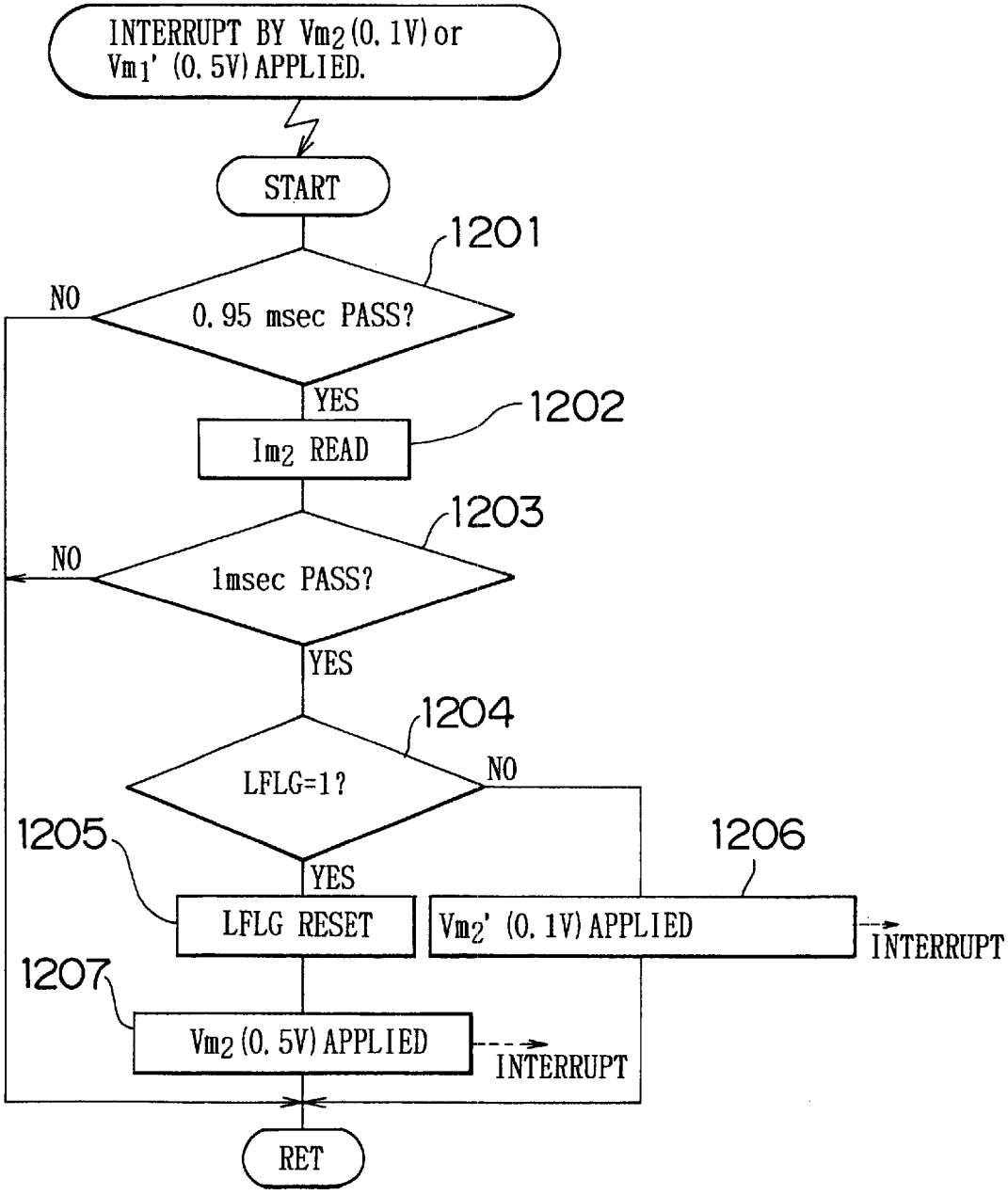
FIG. 12 is a flow chart of third interrupt processing to be executed during the second frequency superimpose processing.

First in step 801 shown in FIG. 8, it is determined whether or not k×64 msec (k: odd number such as 1, 3, 5, . . . ) has elapsed after the start of this routine using a counter, for example. If NO, the processing proceeds to step 1101 (FIG. 12). If YES (that is, when 64 msec, 192 msec, 320 msec . . . has elapsed after the start of this routine), the process proceeds to step 802.

In step 802, it is determined whether or not the air-fuel ratio is lean according to an output of the air-fuel ratio sensor 1. If NO (if the air-fuel ratio is stoichiometric or rich), the process proceeds to step 804. In step 804, a pulse voltage at +0.2 V is applied to the voltage Vm (=0.3V) applied to the air-fuel ratio sensor 1. Therefore, the voltage Vm1' applied to the air-fuel ratio sensor 1 is 0.5 V. If YES in 802 (if the air-fuel ratio is lean), the process proceeds to step 803 where lean determination flag LFLG is set to 1. Then the process proceeds to step 805. In step 805, a pulse voltage at −0.2 V is superimposed on the voltage Vm (−0.3 V) applied to the air-fuel ratio sensor 1. Therefore, the voltage Vm1 applied to the air-fuel ratio sensor 1 at this time is 0.1 V.

In steps 804 and 805, a third timer interrupt processing shown in FIG. 9 is started.

The first timer interrupt processing will be described. In step 901, it is determined whether or not 85 μs is elapsed after start of the third timer interrupt processing. If YES, the process proceeds to step 902 where the output current Im1 of the air-fuel ratio sensor is read. If NO, the process of step 901 is repeatedly executed until the determination result becomes YES.

In step 903, it is determined whether or not 100 μs is elapsed after start of the first timer interrupt. If YES, the process proceeds to step 904 where the output current Im1 of the air-fuel ratio sensor 1 is read. If NO in step 901, the process returns to step 901.

In step 904, it is determined whether or not the lean determination flag LFLG is set in step 803 of FIG. 8. If LFLG=1, the process proceeds to step 905 where the lean determination flag LFLG is reset to 0. Then, the process proceeds to step 907. In step 907, Vm2=0.5 V is applied to the air-fuel ratio sensor 1 so as to start the second timer interrupt shown in FIG. 10.

In step 904, if LFLG=0, the process proceeds to step 906. In step 906, Vm2'=0.1 V is applied to the air-fuel ratio sensor 1 so as to start the second timer interrupt shown in FIG. 10.

Upon the start of the second timer interrupt processing, it is determined in step 1001 whether or not 100 μs is elapsed after start of the first timer interrupt processing. If YES, the process proceeds to step 1002 where Vm=0.3 V is applied to the air-fuel ratio sensor 1 so as to return to the ordinary air-fuel ratio detecting condition. If NO in step 1001, the process of step 1001 is repeatedly executed until the determination result becomes YES.

After carrying out the first and second timer interrupt processings described above, in step 806 (FIG. 8), it is determined whether or not (k×64+4) msec is elapsed (k: an odd number, 1, 3, 5 . . . ) after start of this routine. If NO, this routine is terminated. If YES, the process proceeds to step 807.

In step 807, the first (high frequency) impedance Zacl when applying the first frequency voltage is calculated according to the following formula.

$$Zacl=\Delta Vm/\Delta Im=0.2/(Iml-Ims)$$

In step 808, guard processing of Zacl, that is, a processing for incorporating the Zacl between the lower limit guard value KREL1 (1 Ω) and the upper guard value KREH1 (200 Ω). More specifically, if KREL1≦Zacl≦KREH1, the processing is carried out, keeping the value unchanged. Further, the processing is carried out such that Zaxl=KREL1=1 (Ω) if Zacl<KREL1, and Zacl=KRH1=200 (Ω) if Zacl>KREH1. Ordinarily, this guard processing is carried out to neglect data due to disturbance, A/D conversion error or the like.

Figure 11:
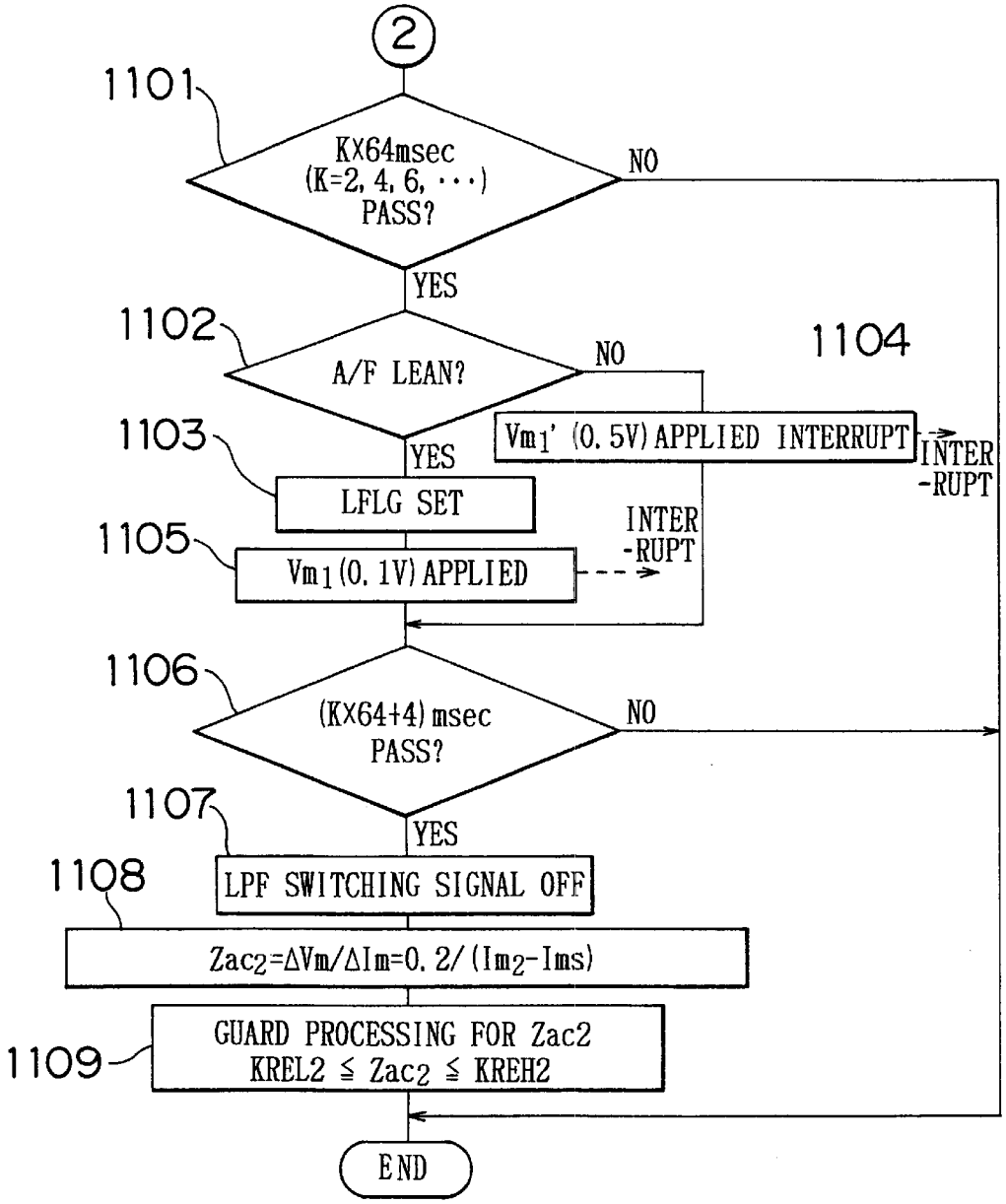
FIG. 11 is a flow chart of second frequency superimpose processing in the impedance calculation routine of the sensor element.
Figure 13:
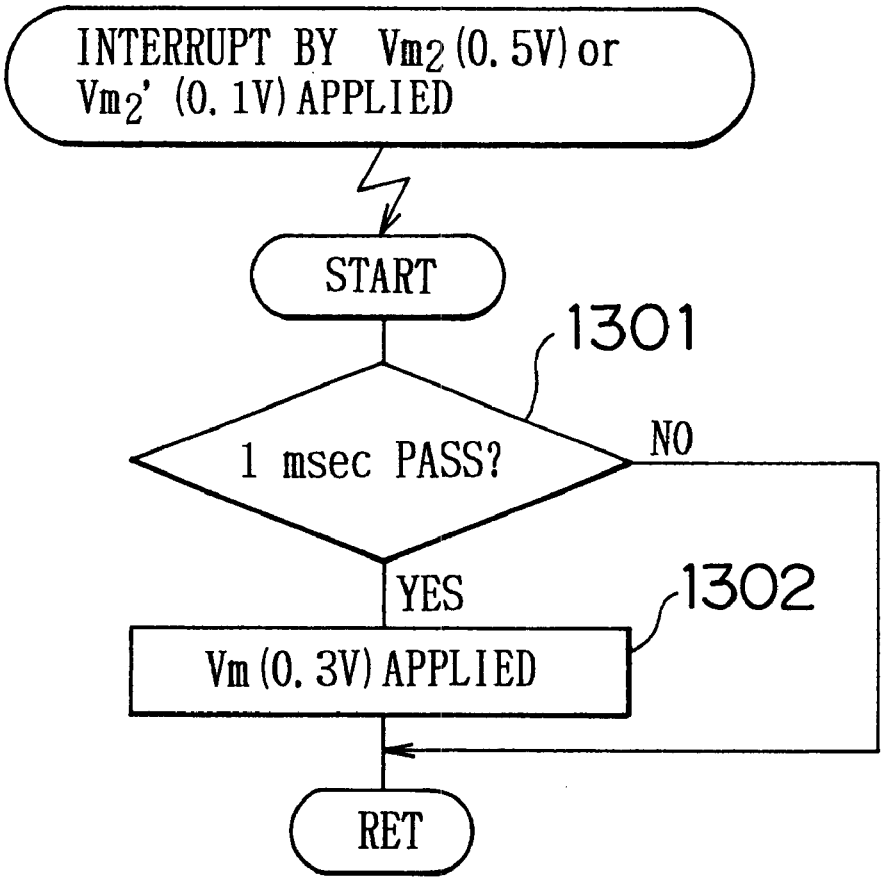
FIG. 13 is a flow chart of fourth interrupt processing to be executed during the second frequency superimpose processing.

A flow chart shown in FIGS. 11 to 13 is for the second frequency superimpose processing of this routine and concerns the processing for maintaining an output of the A/F sensor 1 within a dynamic range shown in FIG. 5 like the above described first frequency superimpose processing. Here, for example, 500 Hz is used as the second frequency.

As described above, if NO in step 801 (FIG. 8), step 1101 is executed. In step 1101, it is determined whether or not k×64 msec (k is an even number, 2, 4, 6, . . . ) has been elapsed from start of this routine using, for example, a counter. If NO, this routine is terminated. If YES (that is, 128 msec, 256 msec, 384 msec from start of this routine), the process proceeds to step 1102.

In step 1102, it is determined whether or not the air-fuel ratio is lean from an output of the air-fuel ratio sensor 1. If NO (if the air-fuel ratio is stoichiometric or rich), the process proceeds to step 1104. In step 1104, a pulse voltage at +0.2 V is superimposed on a voltage Vm (=0.3 V) applied to the air-fuel ratio sensor 1. Therefore, the voltage Vm1' applied to the air-fuel ratio sensor 1 becomes 0.5 V. If YES in step 1102 (if the air-fuel ratio is lean), the process proceeds to step 1103. In step 1103, the lean determination flag LFLG is set to 1 and the process proceeds to step 1105. In step 1105, a pulse voltage at −0.2 V is superimposed on the voltage Vm (−0.3 V) applied to the air-fuel ratio sensor 1. Therefore, the voltage Vm1 applied to the air-fuel ratio sensor 1 at this time becomes 0.1 V.

In steps 1104, 1105, the third timer interrupt processing as shown in FIG. 12 is started.

The third timer interrupt processing will be described. In step 1201, it is determined whether or not 0.95 msec has been elapsed from start of the third timer interrupt processing. If YES, the process proceeds to step 1202 where an output current Iml of the air-fuel ratio sensor 1 is read. If NO, the process of step 1201 is repeatedly executed until the determination result becomes YES.

In step 1203, it is determined whether or not 1 msec has been elapsed from start of the third timer interrupt processing. If YES, the process proceeds to step 1204 where the output current Im1 of the air-fuel ratio sensor 1 is read. If NO in step 1201, the process returns to step 1201.

In step 1204, it is determined whether or not the lean determination flag LFLG is set in step 803 (FIG. 8). If LFLG=1, the process proceeds to step 1205. In step 1205, the lean determination flag LFLG is reset to 0 and the process proceeds to step 1207. In step 1207, Vm2=0.5 V is applied to the air-fuel ratio sensor 1 and the fourth timer interrupt processing as shown in FIG. 13 is started.

If LFLG=0 in step 1204, the process proceeds to step 1206. In step 1206, Vm2'=0.1 V is applied to the air-fuel ratio sensor 1 such that the fourth timer interrupt processing as shown in FIG. 13 is started.

If the fourth timer interrupt processing is started, it is determined whether or not 1 msec has been elapsed from start of the first timer interrupt processing in step 1301. If YES, the process proceeds to step 1302 where a voltage at Vm=0.3 V is applied to the air-fuel ratio sensor 1 so as to bring the air-fuel ratio detection into an ordinary state. If NO in step 1301, the processing of step 1301 is repeatedly executed until the determination result becomes YES.

After carrying out the above mentioned third and fourth timer interrupt processings, it is determined in step 806 (FIG. 8) whether or not (k×64+4) msec (k: an even number, 2, 4, 6, . . . ) has elapsed from start of this routine. If NO, this routine is terminated. If YES, the process proceeds to step 1107.

In step 1107, the LPF selection signal changed in step 705 shown in FIG. 8 is turned OFF with the micro computer 11 and a selection signal for returning the filter constant to one for the high frequency impedance is output to the LPF7.

In step 1108, the first (low frequency) impedance Zac2 when the second frequency voltage is applied is calculated according to the following formula.

$$Zac2=\Delta Vm/\Delta Im=0.2/(Im2-Ims)$$

In step 1109, a guard processing for Zac2, that is, the processing for incorporating the Zac2 between a lower limit guard value KREL2 (1 Ω) and a upper limit guard value (200 Ω) is carried out. More specifically, the processing is carried out so that the Zac2 is kept unchanged if KREL2≦Zac2≦KREH2, Zac2=KREL2=1 (Ω) if Zac2<KREL2, and Zac2=KREH2=200 (Ω) if Zac2>KREH2.

According to this embodiment as described above, as evident from the fact that reading of the limit current Ims of the sensor element 2 in step 707 of FIG. 8 is carried out at every 4 msec (step 706), detection of the air-fuel ratio is disabled within 4 msec elapsing from application of a low frequency pulse for detecting a low frequency impedance.

According to this embodiment, to average load balance on the CPU, a low frequency pulse is applied into the middle of application of the high frequency pulse at every 128 msec. However, the low frequency impedance may be detected by applying the low frequency pulse after an elapse of, for example, 4 msec immediately after application of the high frequency pulse. Further, detection of the second (low frequency) impedance may be carried out once every ten times of the first (high frequency) impedance detecting processings. Further, the detecting processing of the low frequency impedance may be carried out only when the engine is idling, more specifically, when the atmosphere of the air-fuel ratio sensor 1 is stabilized.

Figure 47:
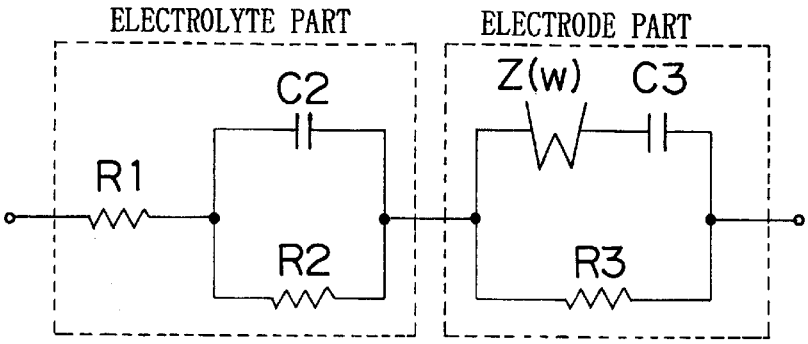
FIG. 47 is a diagram showing an equivalent circuit of the air-fuel ratio sensor element.

Although 5 kHz is set as the first frequency and 500 Hz is set as the second frequency, the present invention is not restricted to this example. The frequency may be selected appropriately considering an electrolyte of the air-fuel ratio sensor, material of electrodes, characteristics of the sensor circuit, applied voltage, temperature, and the like. As the first frequency, the frequency capable of detecting an AC impedance of R1 (bulk resistance of electrolyte)+R2 (granular resistance of electrolyte) in FIG. 47, for example, ranging from 1 kHz to 10 kHz may be used. The second frequency may be set to a frequency lower than the first frequency so far as it is capable of detecting an impedance of R1+R2+R3 (electrode interface resistance).

Although two frequencies are used in this embodiment, plural AC voltages of three or more frequencies may be applied so as to detect an impedance from detected plural sensor output voltage values and current values. It is clear that optimum two impedances may be selected out of plural ones or use a statistical method may be used based on plural impedances. For example, the impedance may be calculated from the average value.

Figure 15:
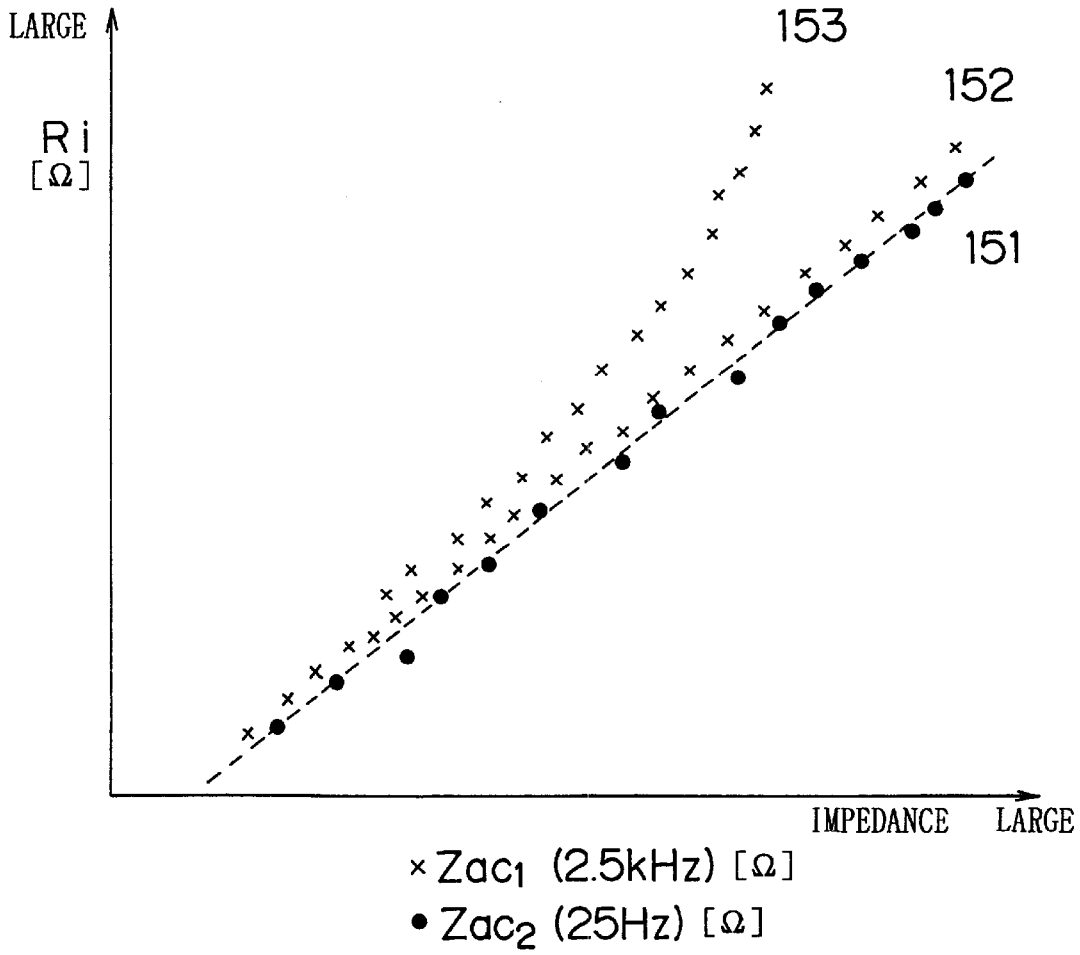
FIG. 15 is a diagram showing a correlation between low frequency impedance and high frequency impedance with respect to a DC current of the air-fuel ratio sensor.

FIG. 15 is a diagram showing the correlation between the low frequency impedance and high frequency impedance with respect to DC current in the air-fuel ratio sensor. Here, the low frequency impedance is detected when an AC voltage at 25 Hz is applied to the sensor element under a predetermined temperature. The high frequency impedance is detected when an AC voltage at 2.5 kHz is applied to the sensor element at a predetermined temperature. A correlation between the DC resistance and low frequency impedance is indicated with a black dot "•" and a correlation between DC resistance and high frequency impedance is indicated with a christcross "x". A line 151 defined by plotting the "•" indicating the correlation between the DC resistance and low frequency impedance is substantially equal when the sensor element is new and when it is deteriorated in durability. On the other hand, as for those lines defined by plotting the "x" marks indicating the correlation between the DC resistance and high frequency impedance, the line 152 indicates a case where the sensor element is new and the line 153 indicates a case where its durability has been deteriorated. In this case, it is evident that the DC resistance Ri is increased when the sensor element is deteriorated in durability as compared to when it is new. This reason is that the high frequency impedance detects a resistance of zirconia electrolyte but not the electrode interface resistance.

The low frequency impedance detecting the electrode interface resistance reflects DC resistance Ri that changes from the time when the sensor element is new to the time when its durability is deteriorated. Therefore, according to the present invention, paying an attention to the fact that the correlation between the DC resistance and low frequency impedance of the air-fuel ratio sensor is linear for both cases where the sensor element is new and its durability has been deteriorated, the low frequency impedance Zac2 is detected. Then, based on the detected Zac2, a degree of deterioration of the air-fuel ratio sensor is defined as DC resistance Ri. In accordance with the Ri that has changed after deterioration, the output of the air-fuel ratio sensor is corrected such that the air fuel ratio can be detected with high accuracy.

Figure 16:
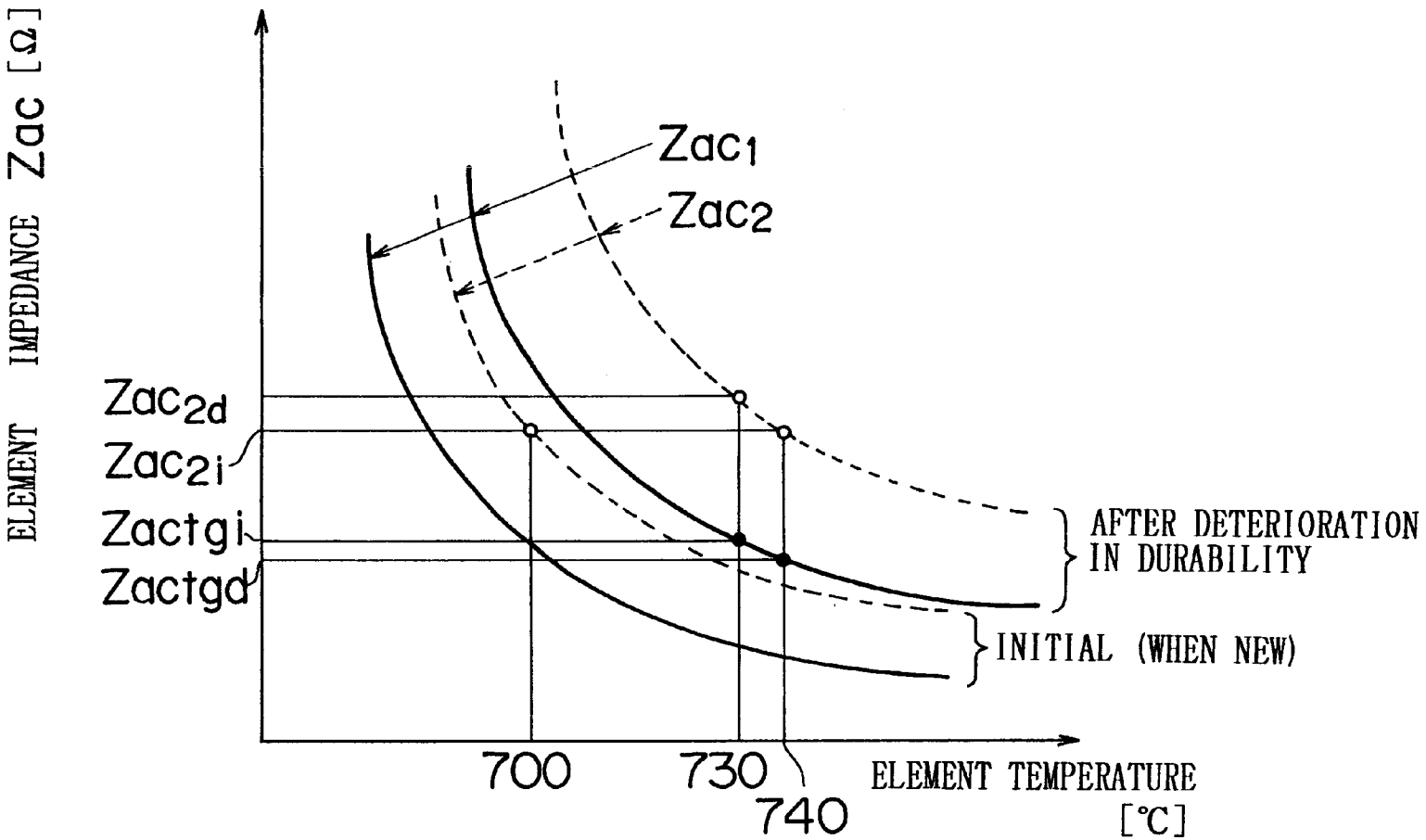
FIG. 16 is a diagram showing a first correlation between an element temperature and impedance which change depending on deterioration of the oxygen concentration detecting element.
Figure 17:
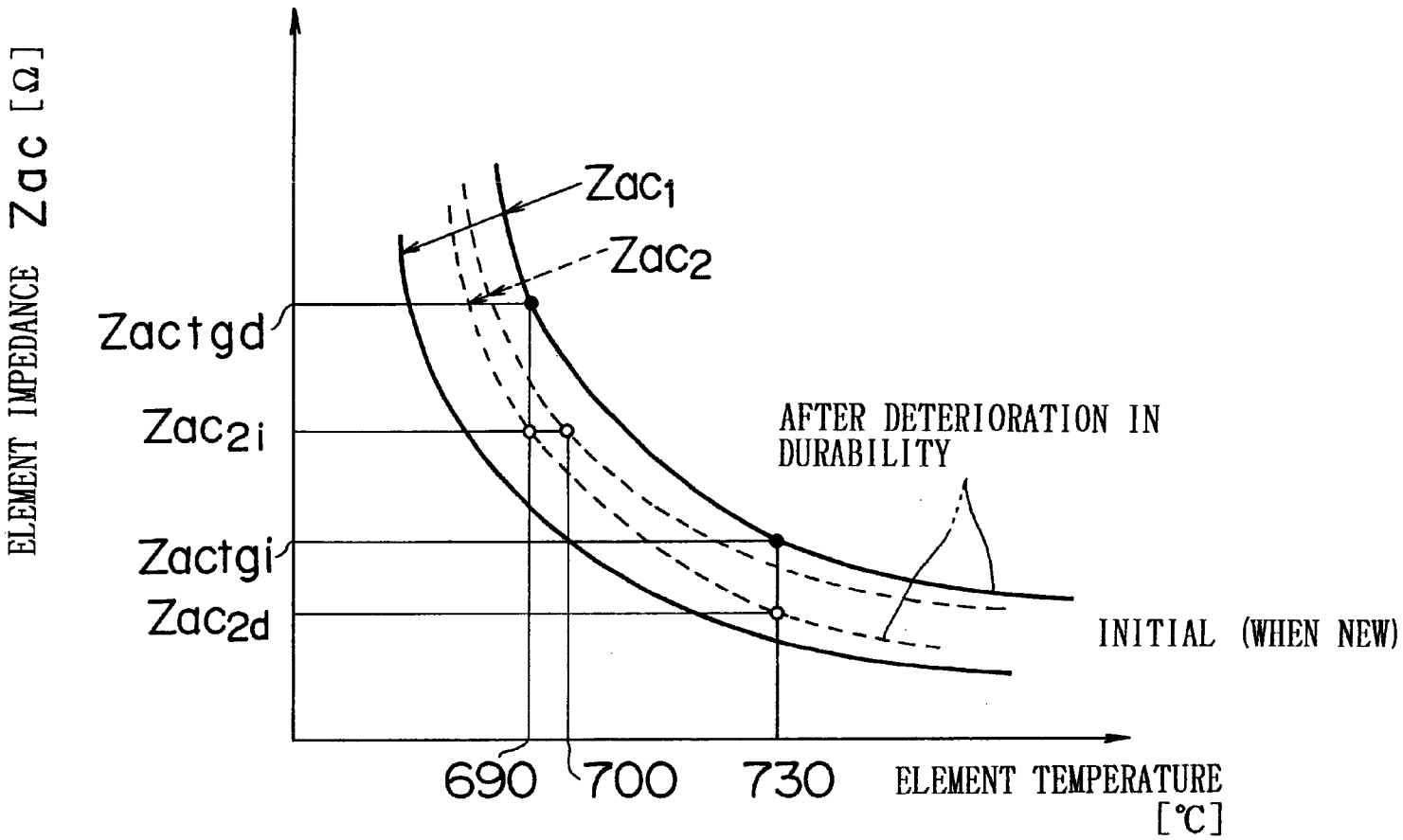
FIG. 17 is a diagram showing a second correlation between an element temperature and impedance which change depending on deterioration of the oxygen concentration detecting element.

FIGS. 16, 17 show a first correlation and a second correlation between the temperature of the element and impedance which change with deterioration of oxygen concentration detecting element. In FIGS. 16, 17, the high frequency impedance Zacl and the low frequency impedance Zac2 are indicated with solid line and dotted line respectively.

As indicated by the solid line of FIG. 16, the curve indicating the correlation between the temperature of the sensor element and Zacl after the deterioration in durability shifts to the right compared with the case where it is new. Therefore, if an element temperature target value Zactg is maintained at the value of Zactgi (target element temperature: 700° C.) when the element is new relative to the sensor element after deterioration in its durability, the temperature of the element of the one having deteriorated durability rises to 730° C. Here, the element temperature target value Zactg refers to an impedance of the element when the element temperature of the air-fuel ratio sensor becomes the target value. As indicated by the dotted line of FIG. 16, the correlation between the temperature of the sensor element after deterioration in durability and Zac2 also shifts to the right compared with the case where it is new. This correlation is generated when the deterioration is accelerated so that the electrode interface resistance of the sensor element due to electrode cohesion to be described later. Therefore, if the element temperature control target value Zactg of the sensor element is maintained at the value Zactgi when it is new, the low frequency impedance changes from Zac2i when the element is new to Zac2d when the element temperature is 730° C. after deterioration in durability.

Deterioration in durability means a deterioration of the sensor element due to durability test and aging means deterioration by age of the sensor element under an ordinary operating condition.

According to the present invention, by maintaining the value of the Zac2 at value Zac2i when the element is new, in other words, by maintaining DC resistance Rs of the sensor element at an initial value, the output characteristic of the air-fuel ratio sensor after the sensor element is deteriorated is maintained at a characteristic of a new product, and the air-fuel ratio is detected with high accuracy based on this output value. Thus, the element temperature is set to 740° C. so that the value Zac2d obtained when it is deteriorated in durability is set to Zac2i obtained when it is new. The Zac1 at that time, that is, Zactgd is set as an element temperature control target value after the element is deteriorated in durability. A difference of the sensor element temperature with respect to Zac1 and Zac2 after deterioration in durability is generated due to a difference between the Zac1 and Zac2 with respect to DC resistance Ri of the sensor element shown in FIG. 15. As evident from FIG. 15, the temperature correction of the sensor element by Zac2 is capable of maintaining the output characteristic of the sensor element better than a correction by Zac1.

Next, FIG. 17 will be described. A curve line indicating a correlation between the temperature of the sensor element and Zac1 after it is deteriorated in durability is shifted to the right as compared to when it is new. Therefore, if the element temperature control target value Zactg of the sensor element is maintained at the value Zactgi obtained when it is new, the element temperature after it is deteriorated in durability rises from 700° C. measured when it is new to 730° C. On the other hand, a curve (dotted line) indicating a correlation between the temperature of the sensor element after it is deteriorated in durability and Zac2 shifts to the left as compared with the case where it is new. This correlation is generated if the deterioration is accelerated so that the diffusion layer of the sensor element is destroyed due to over-heat of the heater or the like. Therefore, if the element temperature control target value Zactg of the sensor element is maintained at the value Zactgi obtained when it is new, the low frequency impedance changes to Zac2d obtained when the element temperature is 730° C. after it is deteriorated in durability with respect to Zac2i obtained when it is new.

According to the present invention, by maintaining the value Zac2 at Zac2i of a new product, in other words, by maintaining the DC resistance Rs of the sensor element at an initial value, the output characteristic of the air-fuel ratio sensor after deterioration in the sensor element is maintained at the characteristic of a new product and the air-fuel ratio is detected with high accuracy based on this output value. However, if the sensor element is almost destroyed like diffusion layer crack, the output characteristic of the air-fuel ratio sensor cannot be maintained. If the element temperature is set to 690° C. so that the value of the Zac2 obtained when the durability is deteriorated becomes the value Zac2l obtained when it is new, and then the Zac1 obtained when the element temperature is 690° C., namely the Zactgd, is assumed to be the element temperature control target value after durability deterioration, the activation condition of the sensor element cannot be maintained.

However, if the value Zac2d obtained when durability is deteriorated becomes larger than the value Zac2l obtained when it is new, it is determined that the air-fuel ratio sensor is in trouble, then the air-fuel ratio feedback control is interrupted.

According to the present invention, as the element temperature control target value Zactg is variable in accordance with a degree of the durability deterioration of the sensor element, the characteristic of the sensor element can be maintained constant even after the element is deteriorated in durability.

Next, as described above, the element temperature control target value Zactg is corrected so that the characteristic of the sensor element after durability deterioration is maintained to the one exhibited by the new product. Next, deterioration correction processing for the air-fuel ratio sensor in step 708 of the flow chart of FIG. 7 will be described.

Figure 18:
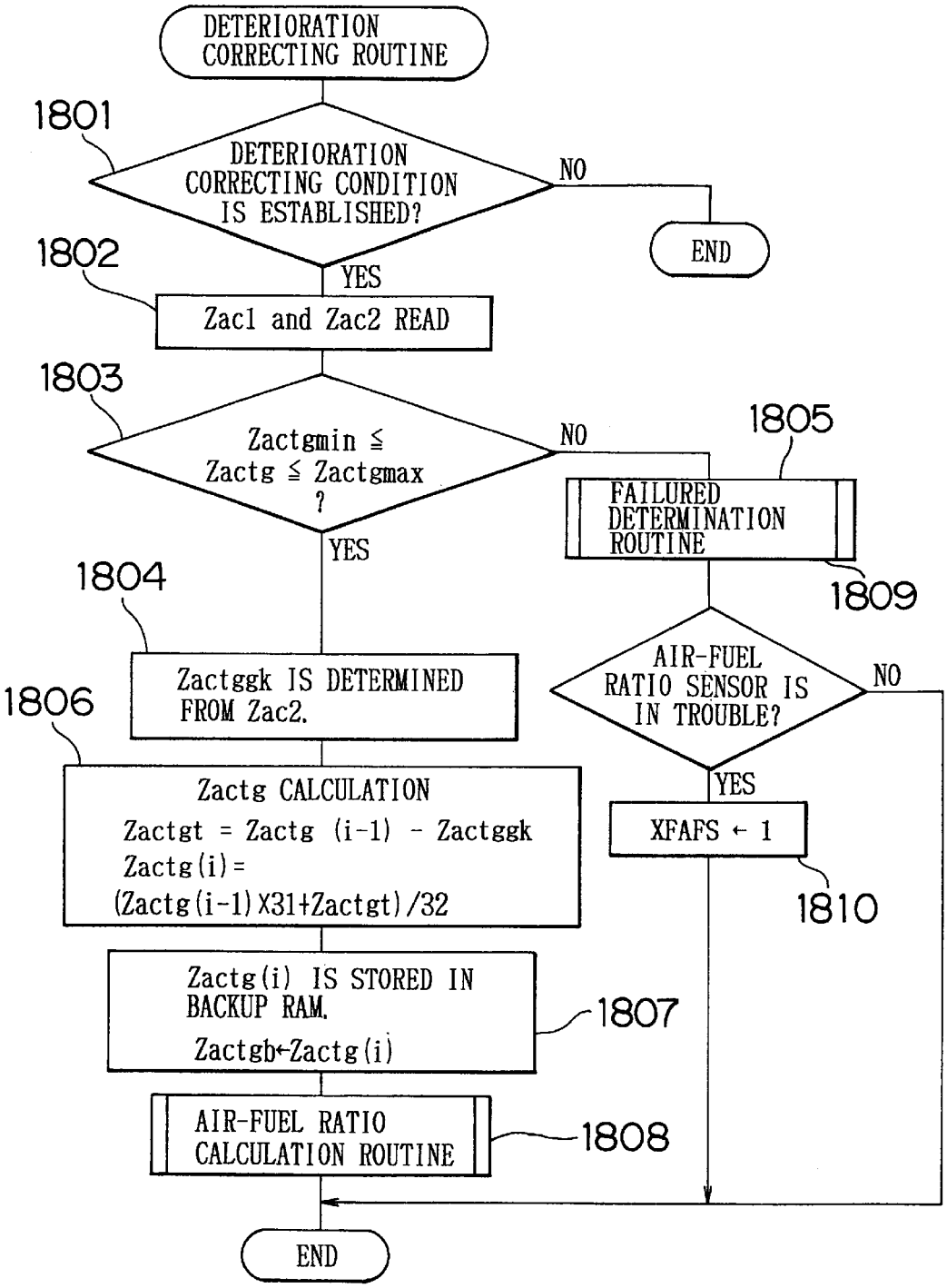
FIG. 18 is a flow chart of deterioration correction routine of the air-fuel ratio sensor.

FIG. 18 is a flow chart of deterioration correcting routine of the air-fuel ratio sensor. This routine corrects the Zactg based on the low frequency impedance Zac2 and is carried out at a predetermined cycle, for example, every 4 msec.

First in step 1801, it is determined whether or not the deterioration correcting condition is established depending on whether or not all conditions 1–5 below are established. If YES, the process proceeds to step 1802. If NO, this routine is terminated.

1. revolutions of an engine NE≦1000 rpm
2. vehicle velocity VS≦3 km/h
3. idle switch ON
4. during air-fuel ratio feedback controlling and the air-fuel ratio A/F is in the vicinity of 14.5
5. cooling water temperature of the engine THW≧85° C. (engine warm-up condition).

In step 1802, the first (high frequency) impedance Zacl and the second (low frequency) impedance Zac2 are read. Here, the Zac2 is obtained as a change of the characteristic of the sensor element, particularly a parameter indicating aging.

Figures 19, 20:
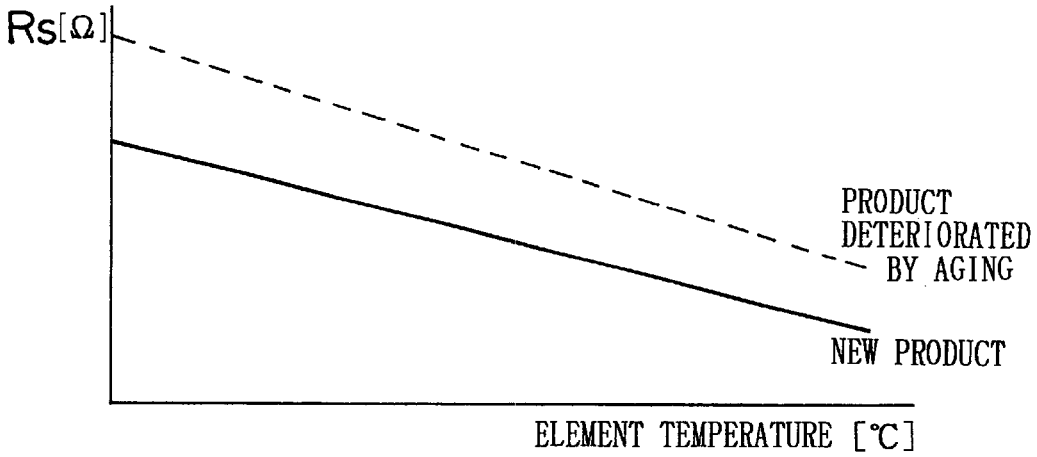
FIG. 19 is a map showing a relation between total element resistance Rs of the air-fuel ratio sensor and an element temperature.
FIG. 20 is a map showing a relation between a correction amount Zacgk of an element temperature control target value and low frequency impedance Zac2.
Figure 21:
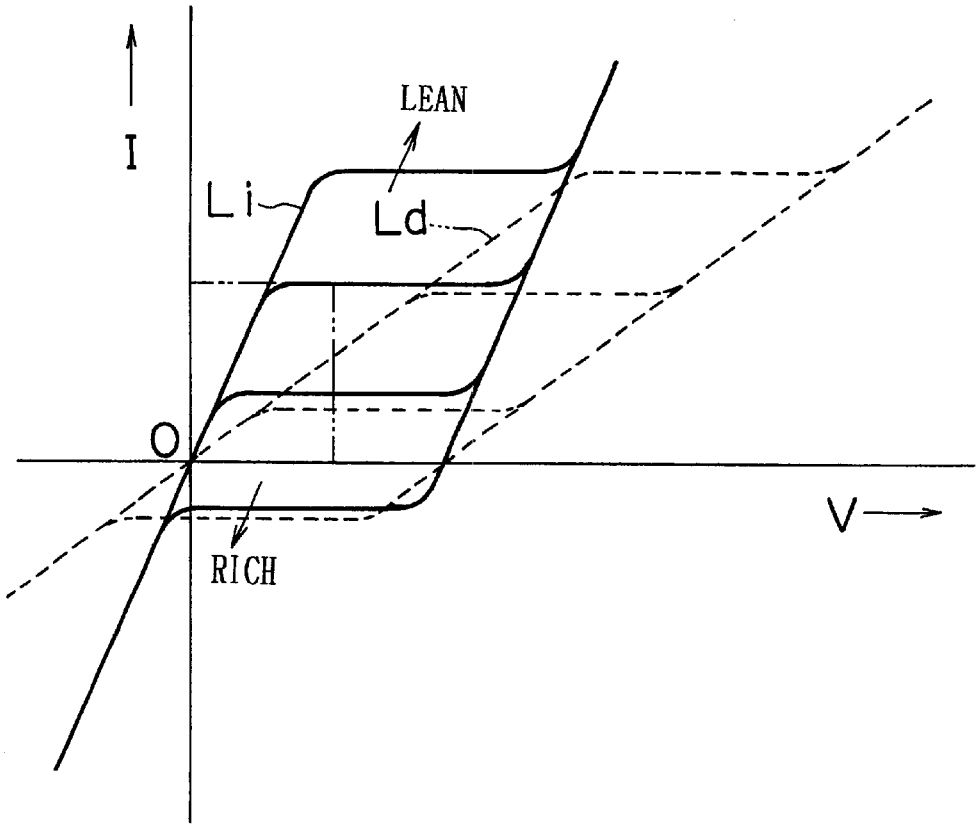
FIG. 21 is a diagram showing output characteristic of the air-fuel ratio sensor.

FIG. 19 is a diagram showing a relation between total element resistance Rs (=R1+R2+R3) of the air-fuel ratio sensor and the element temperature. FIG. 20 is a diagram showing a relation between the correction value Zactggk of the element temperature control target value and the low frequency impedance Zac2 and FIG. 21 is a diagram indicating the output characteristic of the air-fuel ratio sensor.

As evident from FIG. 19, the Rs of an aged product increases as compared with the new product. If the sensor element is aged to increase its Rs, the output characteristic of the air-fuel ratio sensor is changed from a solid line Li indicating a DC resistance when it is new to a dotted line Ld as shown in FIG. 21. Therefore, the limit current value with respect to the same air-fuel ratio drops so that an error is generated in detection of the air-fuel ratio.

The failure determination processing for the air-fuel ratio sensor in step 709 (FIG. 7) described above is achieved by carrying out steps 1803 to 1810. In step 1803, it is determined whether or not the element temperature control target value Zactg of the sensor element is in a range between the upper limit value Zactgmax and the lower limit value Zactgmin including characteristic deviations of the sensor element. If YES (Zactgmin≦Zactg≦Zactgmax), it is determined that the correction of the element temperature control target value is enabled and the process proceeds to step 1804. If NO in step 1804, the process proceeds to step 1805. In step 1804, the correction amount Zactggk of the element temperature control target value Zacctg is calculated from Zac2 according to a map shown in FIG. 20. This correction amount Zactggk is set up so that the Zac2 becomes about 10 to 20 Ω. This map is stored in ROM in advance. As described above, the element temperature control target value mentioned as above means an impedance of the element when the element temperature of the air-fuel ratio sensor reaches a target temperature.

In step 1806, the element temperature control target value Zactg(i) (current value) is calculated as an average value according to the following formula.

$$Zactgt=Zactg(i-1)\ \text{(previous value)}-Zactggk$$

$$Zactg(i)\ \text{(current value)}=(Zactg(i-1)\times 31+Zactgt)/32$$

The Zactg (i)(current value) calculated in this manner is set to the element temperature control target value at the high frequency impedance Zacl of the sensor element 2 so as to carry out heater control for the air-fuel ratio sensor 1.

That is, the sensor element temperature is controlled so that the sensor element impedance is Zactg(i).

As shown in the map of FIG. 20, the element temperature control target correction amount Zactggk increases as the low frequency impedance Zac2 which is a characteristic parameter of the sensor element increases, namely the degree of deterioration of the sensor element 2 is intensified. Therefore, the current element temperature control target value Zactg obtained by subtracting this correction amount from the previous element temperature control target value Zactg is set to be small correspondingly. Therefore, the element temperature after the deterioration is set to a higher target temperature within an allowable range than the value of the new product. This is because, as shown in FIG. 19, the Rs increases after the deterioration so that the characteristic of the sensor element is degraded, the element temperature of the sensor element is corrected to a higher value in order to reduce the Rs for maintaining the characteristic of its new product. On the other hand, if the Zac2 decreases to a predetermined value, the element temperature is corrected so as to be lowered. That is, the temperature of the sensor element is controlled to be different temperature from that when it is new, corresponding to deterioration condition of the sensor element. As a result, even if the sensor element is deteriorated, the sensor characteristic is maintained like a new product. If the deterioration of the sensor element is accelerated so that the electrode interface resistance thereof due to electrode cohesion increases, the Zac2 of the sensor element after the deterioration increases, so that the Zactggk also increases. Therefore, the Zactg(i) decreases so that the element temperature rises. If deterioration of the sensor element is accelerated so that the diffusion layer thereof is destroyed, the Zac2 of the sensor element after deterioration decreases, so that the Zactggk also decreases. Thus, at this time, in steps 1805, 1809, 1810, it is determined that the air-fuel ratio sensor is in trouble so as to stop the air-fuel ratio feedback control. In step 1805, the air-fuel ratio sensor failure determination routine (FIGS. 34 to 44) which will be described later is carried out. In step 1809, the determination is carried out depending on the failure determination result of step 1805. If YES, this routine is terminated. If NO, the process proceeds to step 1810. In step 1810, the air-fuel ratio sensor failure flag XFAF is posted.

In step 1807, the element temperature control target value Zactg is memorized in backup RAM as the Zactgb. This Zactgb is fetched in as the Zactg in an initial routine when the engine is started next, so that the element temperature is controlled to be in the vicinity of a target temperature at the next engine start.

In step 1808, the air-fuel ratio calculation routine is carried out.

In this routine, as described above, since the low frequency impedance indicates the characteristic of the air-fuel ratio sensor, the low frequency impedance is learned and the output value of the sensor element is corrected based on the learned value for calculating the air-fuel ratio accurately.

Figure 22:
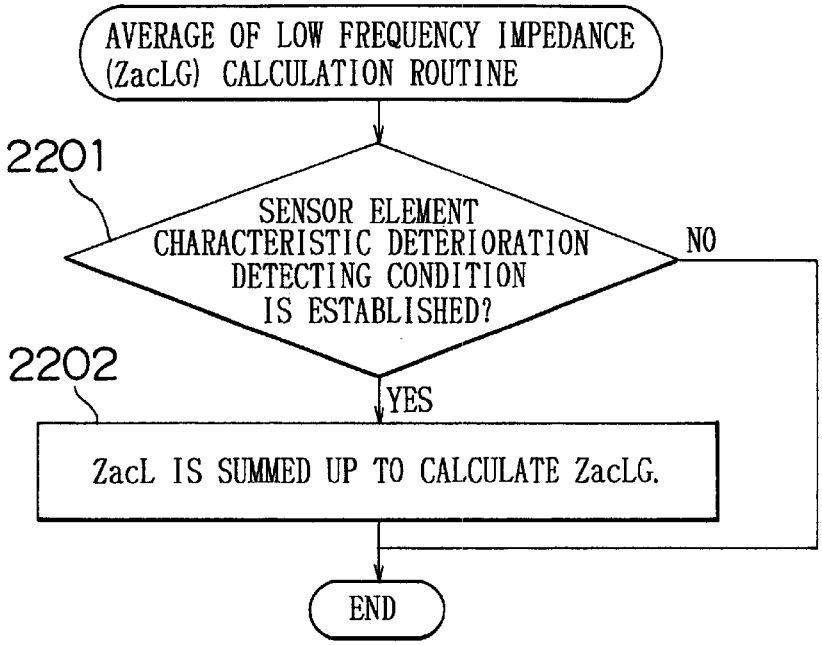
FIG. 22 is a flow chart of a calculation routine for an average value of a low frequency impedance.

FIG. 22 is a flow chart of a low frequency impedance average calculation routine. This routine is carried out at a predetermined cycle, for example, every 100 msec. In step 2201, it is determined whether or not all the sensor element characteristic deterioration detecting conditions are established in order to determine whether or not the characteristic of the sensor element is deteriorated. If YES, the process proceeds to step 2202. If NO, this routine is terminated.

1. Hot idle is stopped
2. Activation state of the air-fuel ratio sensor
3. during air-fuel ratio feedback
4. within a predetermined air-fuel ratio (in the vicinity of the stoichiometric air-fuel ratio).

In step 2202, low frequency impedances ZacL at a predetermined number of revolutions are summed up and its average ZacLG is calculated.

Figure 23:
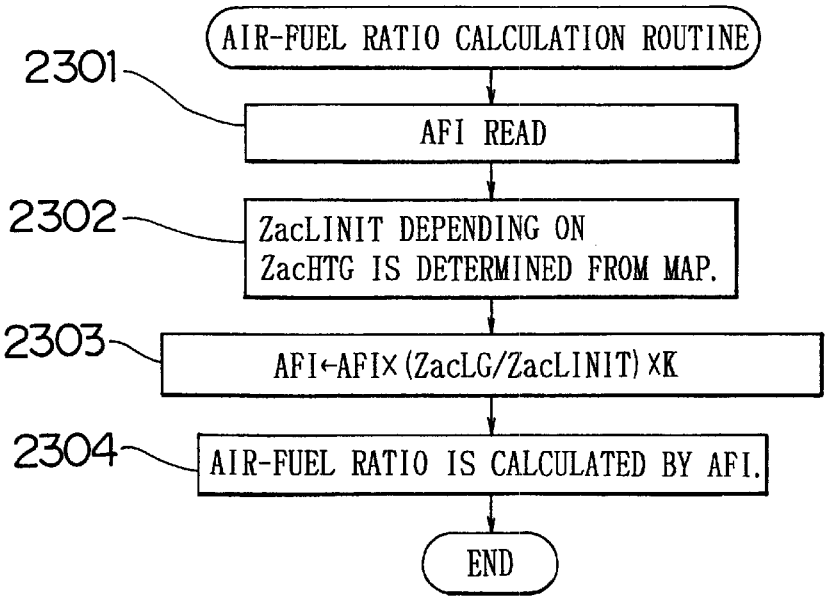
FIG. 23 is a flow chart of an air-fuel ratio calculation routine.

FIG. 23 is a flow chart of the air-fuel ratio calculation routine. This routine is carried out at a predetermined cycle, for example, every 1 msec. In step 2301, a current value AFI of the air-fuel ratio sensor corresponding to the limit current value Im of the air-fuel ratio sensor is read.

Figures 24, 25:
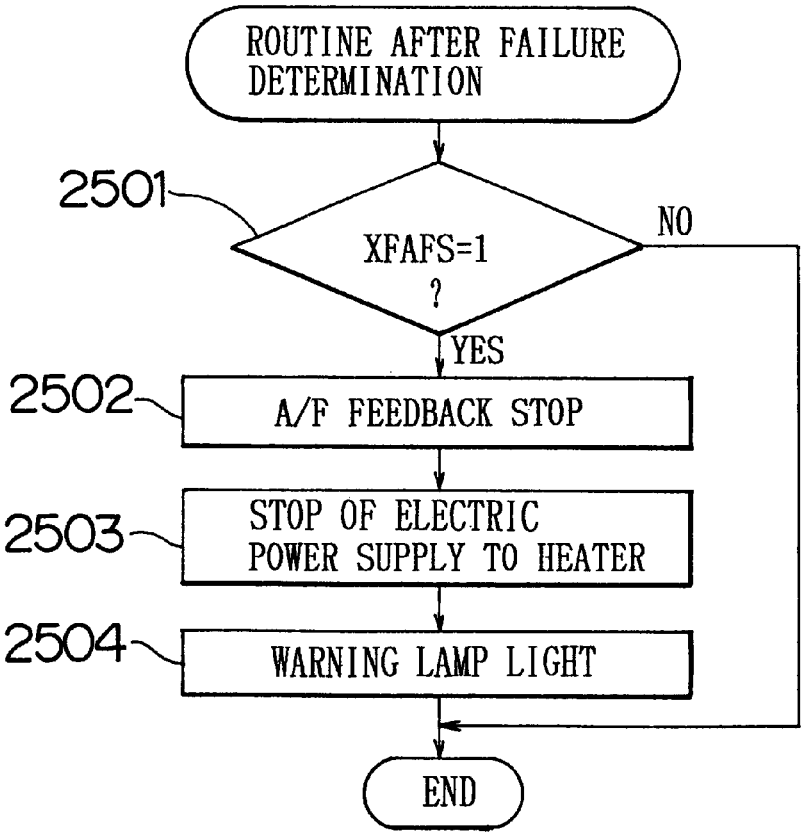
FIG. 24 is a map for calculating an initial value ZacLINIT of the low frequency impedance from a high frequency impedance ZacHTG corresponding to an element temperature control target value.
FIG. 25 is a flow chart of processing routine after a failure of the air-fuel ratio sensor is determined.

In step 2302, an initial value ZacLINIT of the low frequency impedance is obtained corresponding to the high frequency impedance ZacHTG according to the map shown in FIG. 24. FIG. 24 shows a map for obtaining the initial value ZacLINIT of the low frequency impedance from the high frequency impedance corresponding to the element temperature control target value Zactg. The initial value ZacLINT of the low frequency impedance can be obtained as an average of the low frequency impedances of plural sensor elements when they are new.

Next in step 2303, the current value of the air-fuel ratio sensor read in step 2301 is corrected according to the formula below:

$$AFI=AFI\times(ZacLG/ZacLINIT)\times k$$

where k is an appropriate correction coefficient.

As a result, the current value AFI of the air-fuel ratio sensor corresponding to the limit current Im of the sensor element read in step 2301 is corrected.

Next in step 2304, an air-fuel ratio is obtained based on the corrected current value AFI of the air-fuel ratio sensor according to the map preliminarily stored in the ROM.

Next the air-fuel ratio sensor activation determining processing in step 710 (FIG. 7) described before will be described with reference to FIGS. 25 to 27.

FIG. 25 is a flow chart of a processing routine after the failure of the air-fuel ratio sensor is determined. This routine is carried out at a predetermined cycle, for example, every 1 msec. In step 2501, it is determined whether or not the air-fuel ratio sensor failure flag XFAFS is posted. If XFAFS=1, it is determined that the air-fuel ratio sensor is in trouble and the process proceeds to step 2502. In step 2502, the air-fuel ratio feedback control is stopped because exhaust gas emission is degraded when it is continuously carried out. In step 2503, supply of electric power to the heater is stopped to prevent over temperature of the heater. In step 2504, an alarm lamp (not shown) is turned ON. In step 2501, if XFAFS=0, it is determined that the air-fuel ratio sensor is not in trouble and therefore this routine is terminated.

Figures 26, 27:
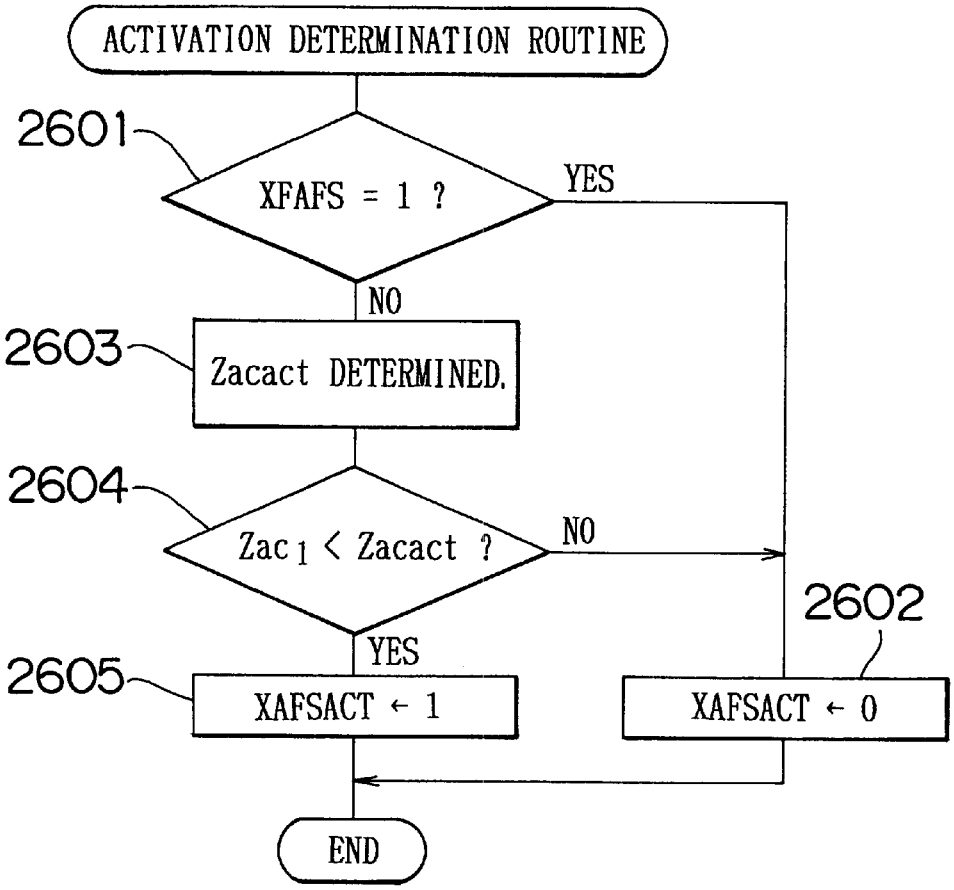
FIG. 26 is a flow chart of a routine for determining activation of the air-fuel ratio sensor.
FIG. 27 is a map for calculating an activation determining value Zacact from the element temperature control target value Zactg.

FIG. 26 is a flow chart of the air-fuel ratio sensor activation determining routine. This routine is carried out at a predetermined cycle, for example, every 1 msec. First, in step 2601, it is determined whether or not the air-fuel ratio sensor failure flag XFAFS is posted. If it is determined that the element is in trouble (XFAFS=1), the process proceeds to step 2602. If it is determined that the element is not in trouble (XFAFS=0), the process proceeds to step 2603.

In step 2602, the air-fuel ratio activation flag XAFSACT is turned OFF. In step 2603, an activation determination value Zacact corresponding to the element temperature control target value Zactg after the deterioration is corrected is obtained from the map shown in FIG. 27. As shown in FIG. 27, to provide the element temperature control target value with an allowance, the activation determination value Zacact is set to be slightly larger than the element temperature control target value Zactg in order to determine the activation of the sensor element at a temperature slightly lower than the target temperature.

In step 2604, it is determined whether or not the high frequency impedance Zacl is smaller than the activation determination value Zacact. If YES (Zacl<Zacact), it is determined that the air-fuel ratio sensor is activated and the process proceeds to step 2605. If NO (Zacl≧Zacact), it is determined that the air-fuel ratio sensor is not activated and the process proceeds to step 2602. In step 2605, the air-fuel ratio activation flag XAFSACT is turned ON.

As described above, an activation determination value Zacact is obtained from the element temperature control target value after the deterioration calculated from the low frequency impedance Zac2 of the sensor element and then this is compared with the high frequency impedance Zacl so as to determine whether or not the sensor element is activated.

Figure 28:
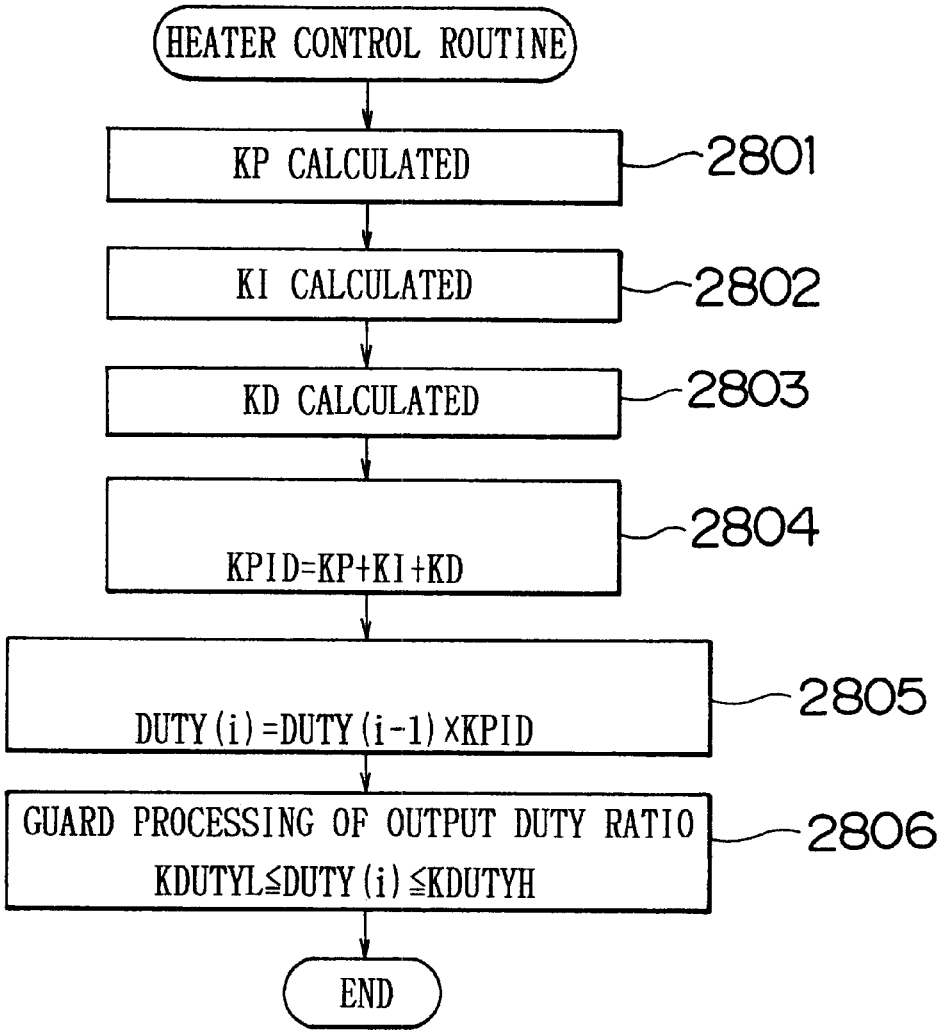
FIG. 28 is a flow chart of a heater control routine.

FIG. 28 is a flow chart of the heater control routine. This routine is carried out at a predetermined cycle, for example, every 128 msec. PID control on the duty ratio of energization to the heater 4 is carried out based on a difference Zacerr (=Zactg−Zacl) between the high frequency impedance of the air-fuel ratio sensor and the element temperature control target value Zactg. Here, the Zactg is calculated from the low frequency impedance and changes with deterioration thereof due to electrode cohesion or the like of the air-fuel ratio sensor 1.

First, in step 2801, a proportional term KP is calculated from the following formula.

$$KP=Zacerr\times K1 \text{ (K1: constant)}$$

In step 2802, an integration term KI is calculated from the following formula.

$$KI=\Sigma Zacerr\times K2 \text{ (K2: constant)}$$

In step 2803, a differential term KD is calculated from a following formula.

$$KD=(\Delta Zacerr/\Delta t)\times K3 \text{ (K3: constant)}$$

In step 2804, PID gain KPID is calculated from the following formula.

$$KPID=KP+KI+KD$$

In step 2805, an output duty ratio is calculated from the following formula.

$$DUTY\ (i)=DUTY\ (i-1)\times KPID$$

In step 2806, guard processing for output duty ratio DUTY(i) is carried out so that the processing for incorporating the DUTY (i) between a lower limit value KDUTYL and a upper limit value KDUTYH is carried out. More specifically, when DUTY(i)<KDUTYL, DUTY(i)=KDUTYL. If KDUTYH<DUTY(i), DUTY(i)=KDUTYH. If KDUTYL≦DUTY(i)≦KDUTYH, DUTYI(i) is kept unchanged.

In heater control shown in FIG. 28, it is determined whether or not the impedance of the sensor element with respect to the high frequency (Zacl≦Zactg5(Ω)) exceeds a predetermined value, for example, 5 Ω from the element temperature control target value Zactg after the deterioration is corrected in order to prevent over temperature of the heater 4 and the sensor element 2. If YES, it is determined that the condition is normal or the heater 4 and sensor element 2 do not reach the over temperature. Then, the heater control routine shown by the flow chart of FIG. 28 is executed. If NO, it is determined that the condition is abnormal or the heater 4 and the sensor element 2 reach the over temperature and a processing for setting DUTY (i)=0 is carried out. The element temperature control target value Zactg is calculated corresponding to the low frequency impedance Zac2 of the sensor element according to the map shown in FIG. 20.

Next a control for detecting the air-fuel ratio at low temperatures where the sensor element temperature is below 700° C. before the air-fuel ratio sensor reaches its activation state will be described below.

Figure 29:
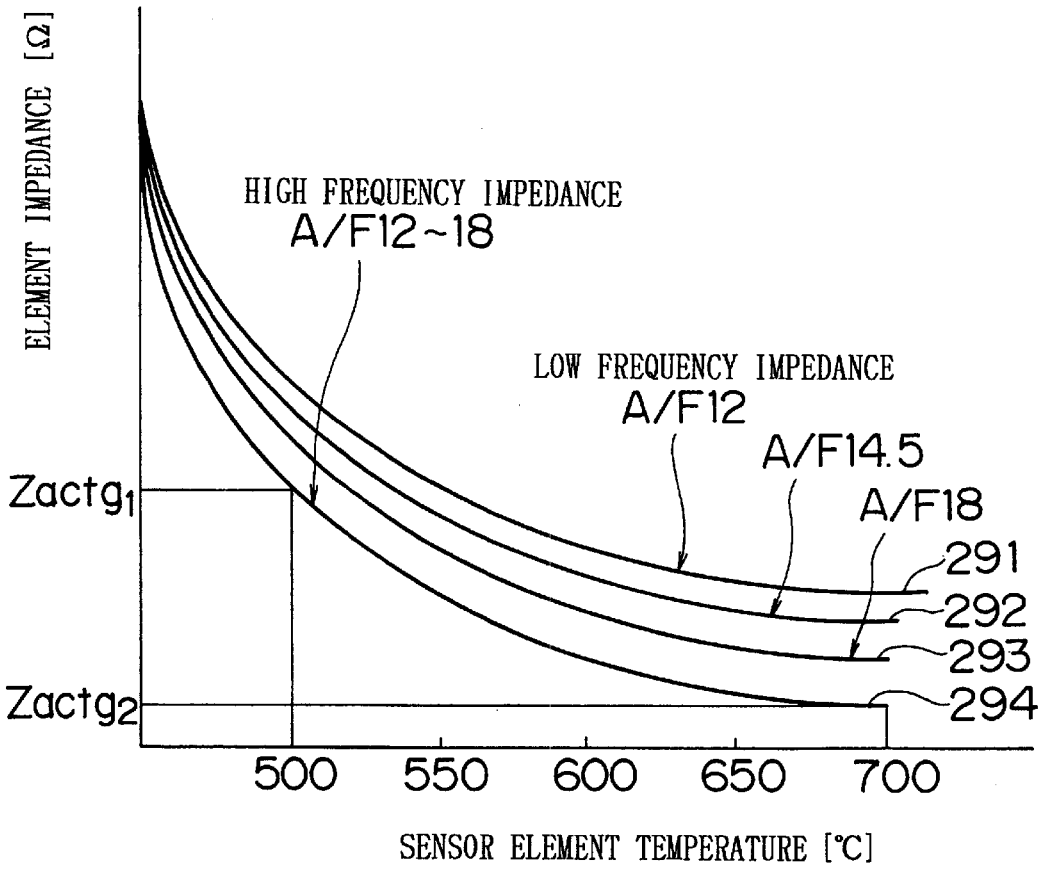
FIG. 29 is a diagram showing a relation between the temperature characteristic and air-fuel ratio of the high frequency impedance and low frequency impedance.

FIG. 29 is a diagram showing a relation between each of the high frequency impedance and low frequency impedance and the sensor temperature. The temperature characteristic of the high frequency impedance indicated by a bold line 280 is substantially kept unchanged in spite of the change in the air-fuel ratio in the atmosphere of the sensor element. As regards the low frequency impedances indicated by fine lines 291, 292, 298, each temperature characteristic changes if the air-fuel ratio which is environment of the sensor element is changed to A/F=12, 14.5, 18.

If a sensor element temperature is detected from the high frequency impedance according to this relation and when the sensor element temperature is low (or when the air-fuel ratio sensor is not activated), the air fuel ratio control can be started at an earlier stage by calculating the air-fuel ratio from the low frequency impedance.

Next, using FIGS. 30 to 33, control for calculating the air-fuel ratio from the low frequency impedance when the sensor element is not activated will be described.

Figures 30, 31:
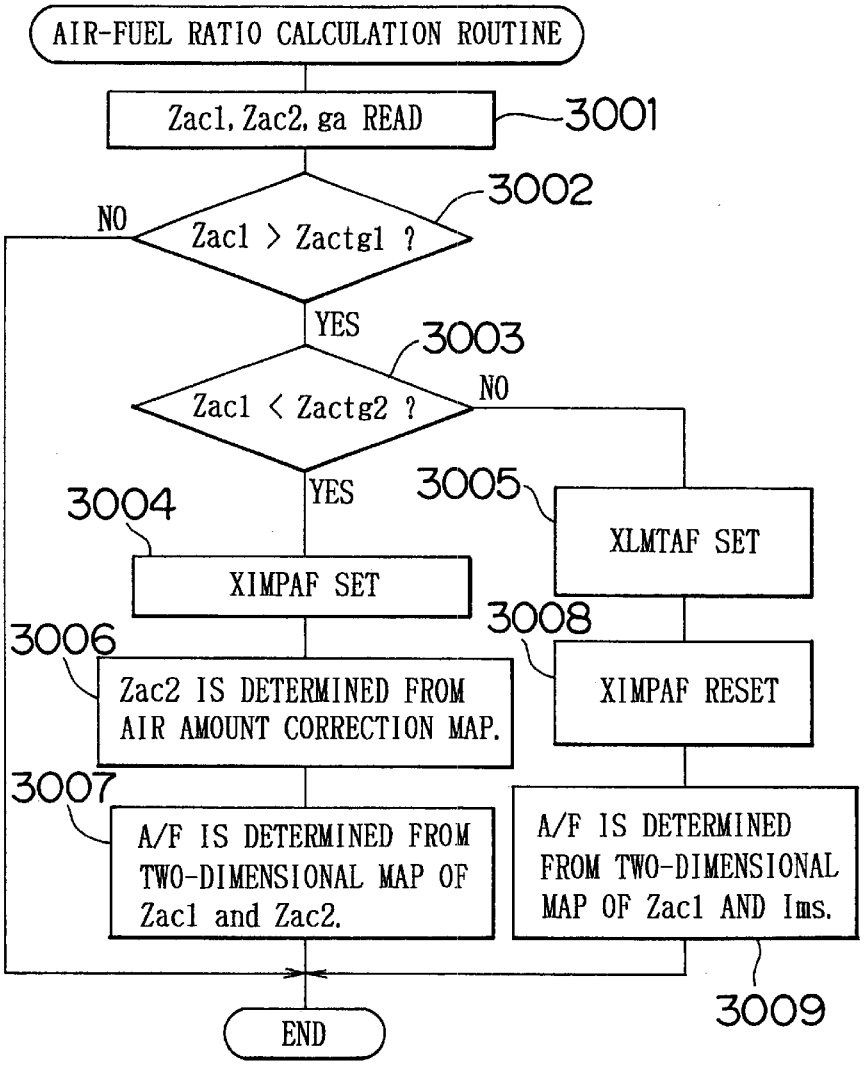
FIG. 30 is a flow chart of an air-fuel ratio calculation routine.
FIG. 31 is a map for correcting the low frequency impedance from air quantity.

FIG. 30 is a flow chart of this routine. This routine is carried out at a predetermined cycle, for example, every 1 msec. In step 3001, intake air amount ga (g/sec) is read from the high frequency impedance Zacl of the sensor element 2, low frequency impedance Zac2, limit current Ims and engine air flow meter (not shown). In step 3002, the Zacl is compared with the first element temperature control target value Zacg1 corresponding to the first element temperature (for example, 500° C.). If Zacl<Zactgl or it is determined that the current element temperature is the first element temperature (500° C.) or less, this routine is terminated. If Zacl>Zactgl or it is determined that the element temperature exceeds the first element temperature (500° C.), the process proceeds to step 3003.

As accuracy of detecting the air-fuel ratio from the low frequency impedance is insufficient in the state where the element temperature is lower than the first element temperature, the air-fuel ratio feedback control is not carried out at this time.

In step 3003, the Zacl is compared with the second element temperature control target value Zactg2 which corresponds to the second element temperature (for example, 700° C.). The second element temperature is higher than the first element temperature and set to be higher than a temperature in which the sensor element is activated. If Zacl<Zactg2 or it is determined that the current element temperature is less than the second element temperature (700° C.), the process proceeds to step 3004. If Zacl≧Zactg2 or it is determined that the element temperature is more than the second element temperature (700° C.), the process proceeds to step 3005.

In step 3004, a flag XIMPAF for indicating that the air-fuel ratio is being calculated based on the low frequency impedance Zac2 of the sensor element is set to 1. In step 3006, a correction factor kgz(%) corresponding to the intake air amount ga read in step 3001 is calculated according to the map indicating a relation between the intake air amount ga and low frequency impedance correction factor kgaz(%) shown in FIG. 31. Then, the low frequency impedance Zac2 at that time is calculated from the calculated kgaz and the Zac2 read in step 3001 according to the following formula.

$$Zac2=Zac2(1+kgaz/100)$$

The calculated value is stored in the backup RAM. The above formula indicates that the electrode interface resistance R3 of the sensor element begins to increase when the intake air amount exceeds 20(g/sec) so that the low frequency impedance Zac2 begins to increase. Accordingly the Zac2 is corrected corresponding to the intake air amount.

Next in step 3007, the air-fuel ratio is calculated according to two-dimensional map for calculating the air-fuel ratio based on the high frequency impedance Zacl and the low frequency impedance Zac2 shown in FIG. 32. In this two-dimensional map, the Zacl indicates the temperature characteristic of the sensor element and therefore, as the Zacl increases, the element temperature decreases. If the element temperature is constant, as evident from FIG. 29, as the Zac2 increases, the air-fuel ratio decreases or becomes richer. According to this embodiment, the sensor element temperature is detected from the high frequency impedance and even if the sensor element temperature is so low that the air-fuel ratio sensor is not activated, the air-fuel ratio is calculated from the low frequency impedance so as to start the air-fuel ratio control early.

In step 3005, a flag XLMTAF indicating that the air-fuel ratio is being calculated from the limit current of the sensor element 2 is set to 1. Next, in step 3008, a flag XIMPAF indicating that the air-fuel ratio is being calculated based on the Zac2 is reset to 0. Next in step 3009, the above described air-fuel ratio calculation routine is carried out.

Figure 33:
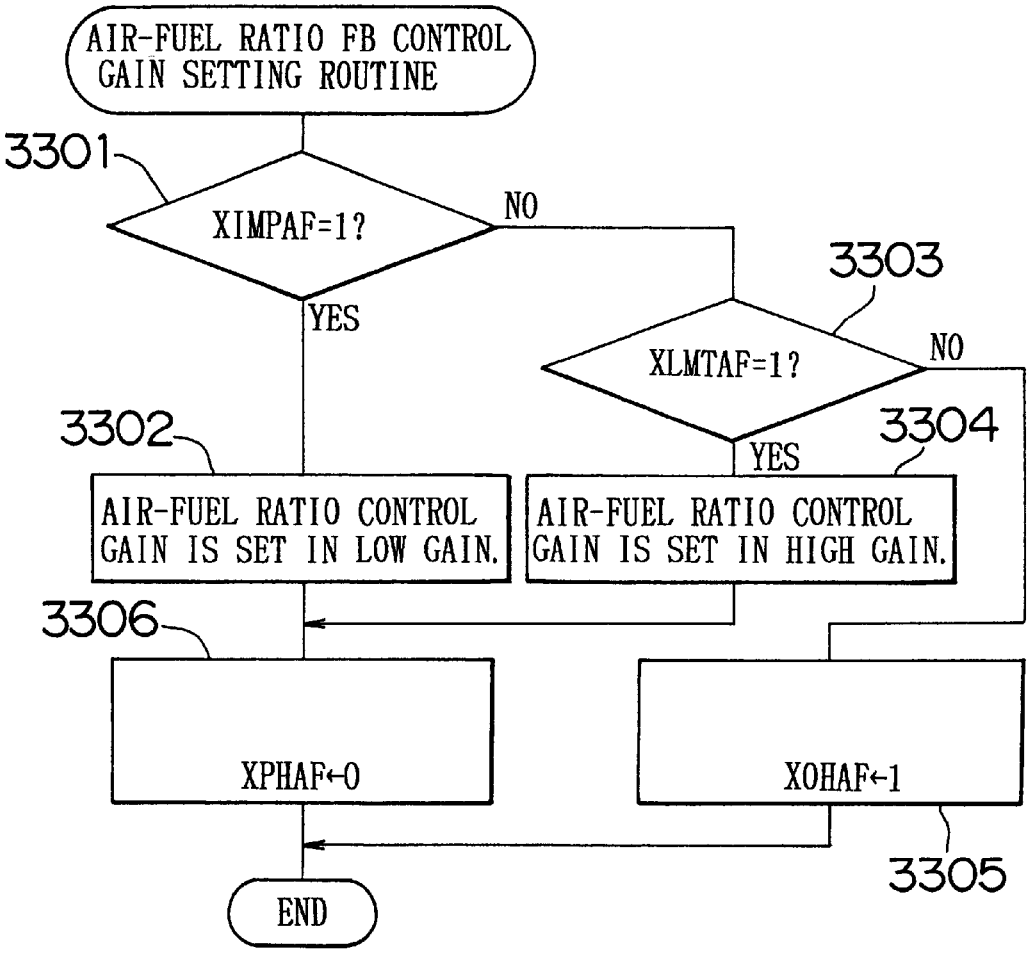
FIG. 33 is a flow chart of a setup routine for air-fuel ratio feedback control gain.

Next a flow chart of air-fuel ratio feedback control gain setting routine shown in FIG. 33 will be described. According to this routine, as the output response of the air-fuel ratio sensor 1 is delayed when the temperature of the sensor element 2 is low. Therefore, when the air-fuel ratio feedback control is carried out based on the low frequency impedance (when YES in step 3301), each gain of the proportional term P, integration term I and differential term D in the air-fuel ratio feedback control is set to LOW gain in step 3302. If the flag XLMTAF indicating that the air-fuel ratio feedback control is being executed is set up according to the limit current after the sensor element 2 is activated (when NO in step 3301 and YES in step 3303), each gain of the aforementioned PID is set to HIGH gain in step 3304. The flag XIMTAF indicated in step 3301 is a flag to be set when the air-fuel ratio is being calculated from the low frequency impedance Zac2 of the sensor element 2. When the determination is NO in step 3301 and NO in step 3303, the temperature of the sensor element is 500° C. or less so that the air-fuel ratio cannot be detected. Then the air-fuel ratio feedback control inhibit flag XPHAF is set to 1 in step 3305. After the air-fuel ratio control gain is set to LOW and HIGH in steps 3302, 3304, the air-fuel ratio feedback control inhibit flag XPHAF is reset to 0 in step 3306.

Next the air-fuel ratio sensor failure determination processing in step 1805 of the flow chart in FIG. 18 will be described with reference to FIGS. 34 to 44.

Figure 34:
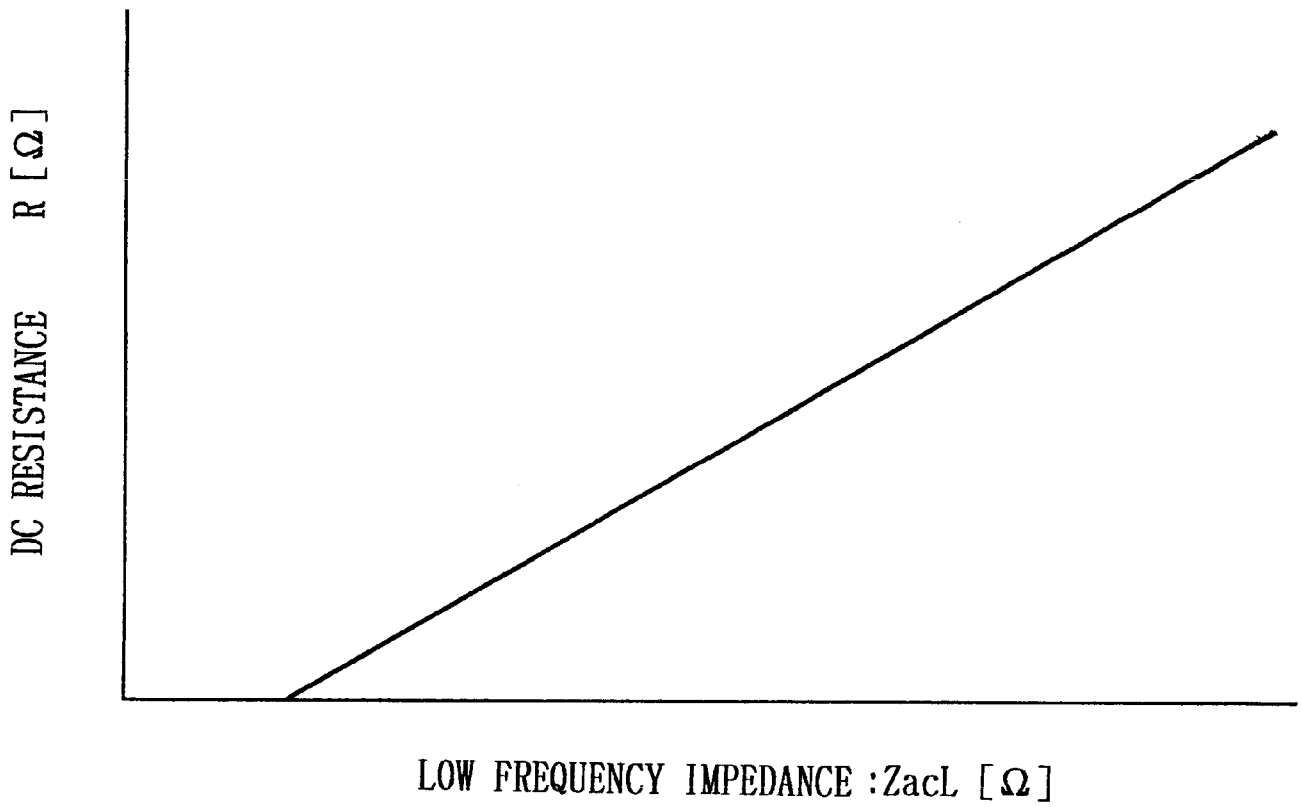
FIG. 34 is a diagram showing a correlation between DC current and low frequency impedance of the air-fuel ratio sensor under a predetermined temperature.

FIG. 34 is a diagram showing a correlation between the DC resistance and low frequency impedance of the air-fuel ratio sensor at a predetermined temperature. As shown in FIG. 34, the DC resistance Ri of the sensor element is proportional to the low frequency impedance ZacL. Therefore, the DC resistance Ri of the sensor element indicating the characteristic of the air-fuel ratio sensor is obtained as the low frequency impedance ZacL and the characteristic deterioration of the air-fuel ratio sensor is detected according to the resultant ZacL.

Figure 35:
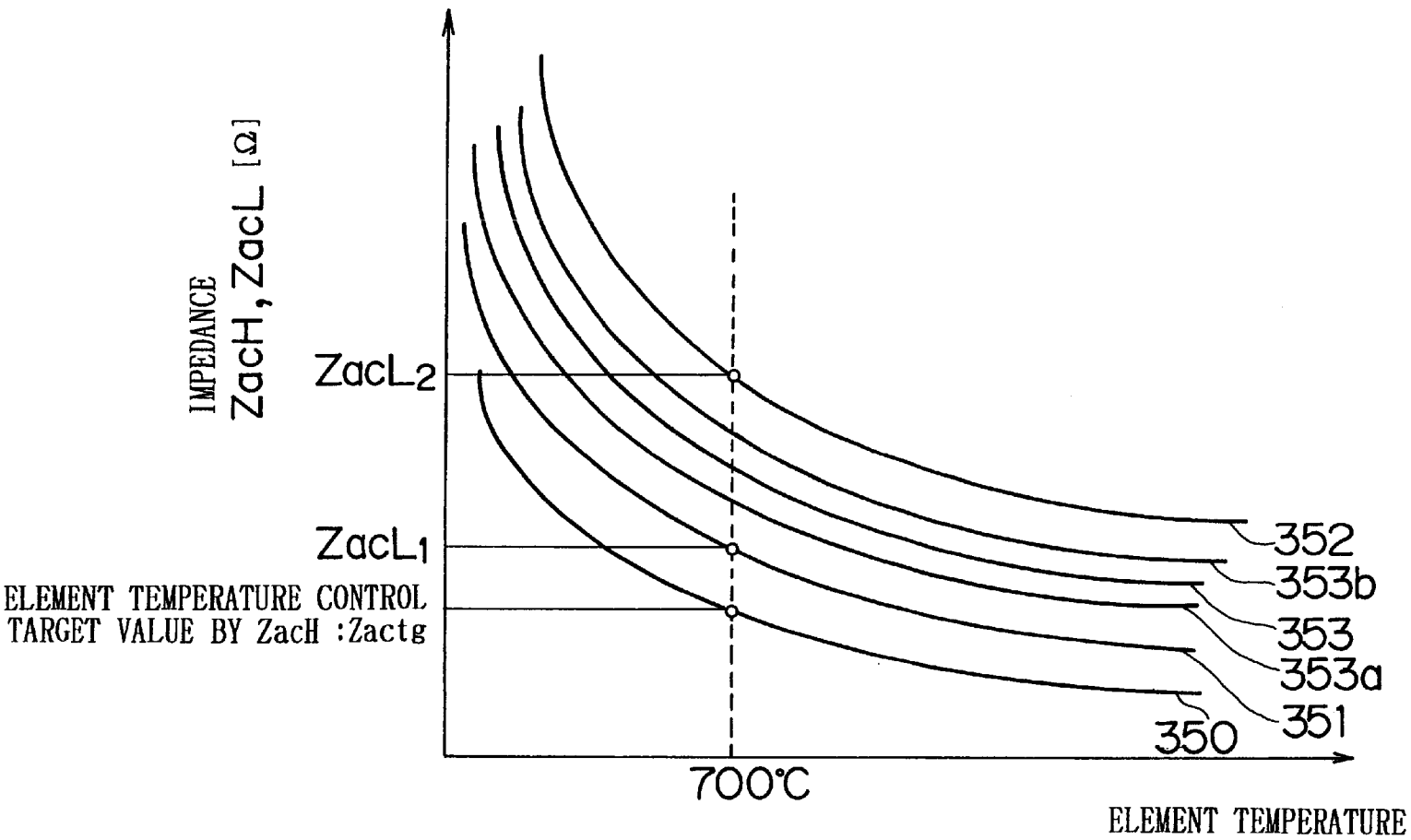
FIG. 35 is a diagram showing changes of the characteristic of low frequency impedance in a deteriorated air-fuel ratio sensor.

FIG. 35 is a diagram showing a change of the characteristic of the low frequency impedance of a deteriorated air-fuel ratio sensor. In FIG. 35, the axis of abscissa indicates a temperature of the sensor element and the axis of ordinate indicates an impedance of the sensor element. The characteristic of the high frequency impedance ZacH with respect to the temperature of the sensor element is indicated by a curve 350. In this case, the change of the impedance characteristic is small in an interval from the time when it is new to the time when its durability is deteriorated regardless of the deterioration of the sensor element. Therefore, the high frequency impedance ZacH can be used as a parameter indicating the temperature of the sensor element. On the other hand, the change of the low frequency impedance ZacL is increased depending on the deterioration of the sensor element. The change differs depending on when the internal resistance of the sensor element decreases in case cracks or the like occur in the diffusion layer due to overheating by the heater (indicated by a curve line 351), when the internal resistance of the sensor element increases due to electrode cohesion or the like (indicated by a curve 352) or the like. The characteristic of the low frequency impedance ZacL with respect to the temperature of the sensor element when it is new is indicated by a curve 353. If an allowance is included, the curve 353 exists in the range from a curve 353*a* to a curve 353*b*.

The element temperature control target value Zactg is determined as the high frequency impedance ZacH corresponding to the activation temperature 700° C. of the sensor element. When the heater control for the sensor element is carried out so that the temperature of the sensor element is 700° C., the low frequency impedance ZacL changes depending on the deterioration of the sensor element. Because the internal resistance of the sensor element decreases when cracks or the like occur in the diffusion layer, for example, the output of the air-fuel ratio sensor increases such that it changes in the direction that the response is accelerated, up to ZacL1 (curve 351). Further, because the internal resistance of the sensor element increases if the electrode cohesion or the like occurs, the output of the air-fuel ratio sensor decreases such that it changes in the direction that the response is decelerated, up to ZacL2 (curve 353).

Figure 36:
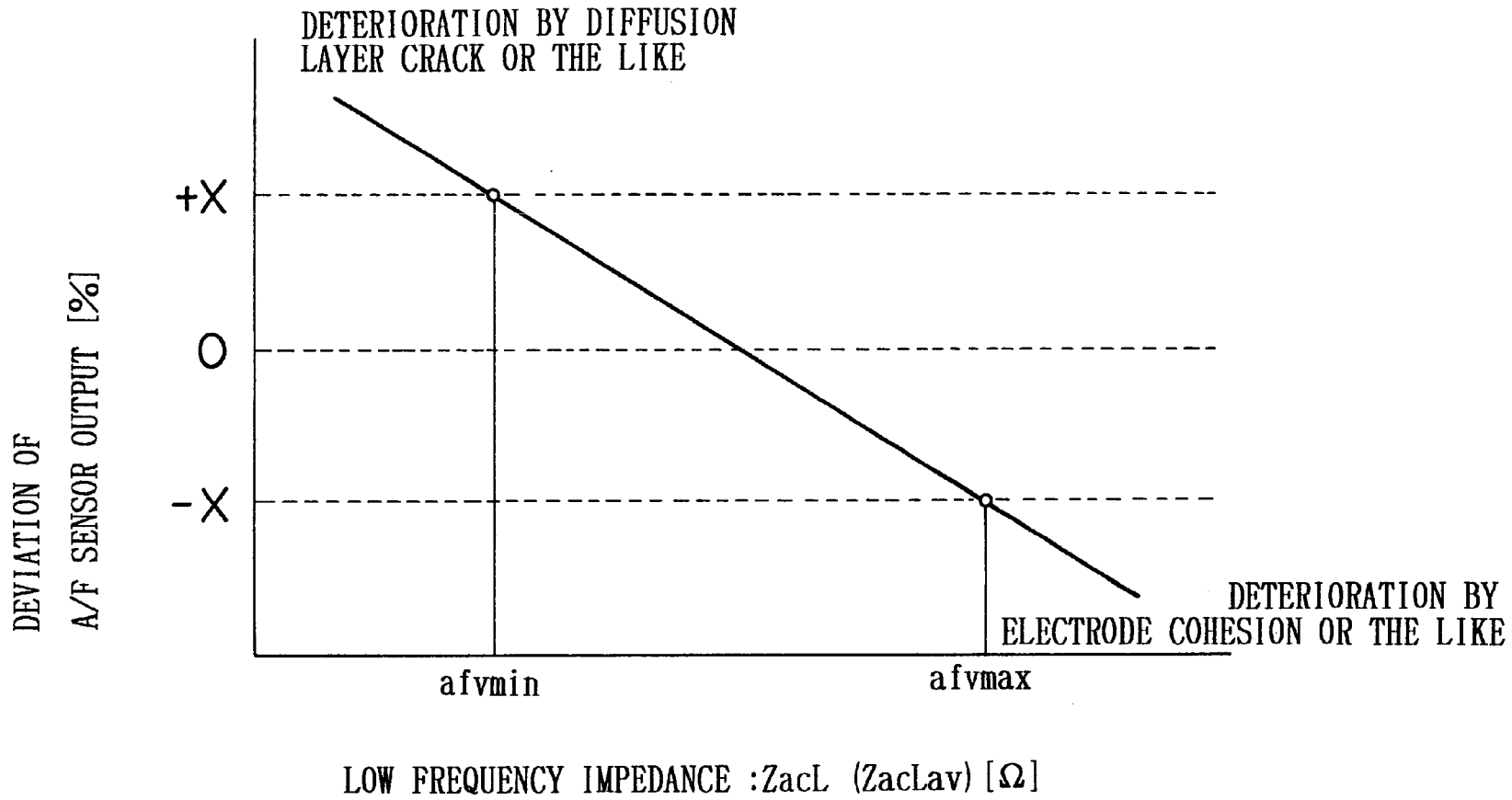
FIG. 36 is a diagram showing a correlation between deviation of the output of the air-fuel ratio sensor and low frequency impedance under high frequency impedance.

FIG. 36 shows a correlation between a deviation of the output of the air-fuel ratio sensor and the low frequency impedance under a condition in which the high frequency impedance is constant. The correlation changes depending on the temperature of the sensor element, or the high frequency impedance. As described with reference to FIG. 35, when the high frequency impedance of the sensor element is the element temperature control target value Zactg corresponding to the sensor temperature 700° C., the low frequency impedance changes from ZacL1 to ZacL2. When the low frequency impedance ZacL lowers after deterioration in durability (ZacL1), the DC resistance Ri decreases so that the output of the air-fuel ratio sensor shifts to the positive side (+X,X>0). Further, when the ZacL increases after the deterioration in durability (ZacL2), the DC resistance Ri also increases so that the output of the air-fuel ratio sensor shifts to negative side (−X). When the deviation of the output of the air-fuel ratio sensor exceeds +X and shifts to the positive side, it is determined that the sensor element is deteriorated due to diffusion layer crack or the like. When the deviation of the output of the air-fuel ratio sensor exceeds −X and shifts to the negative side, it is determined that the sensor element is deteriorated due to electrode cohesion or the like. The minimum allowance of the average ZacLav of the low frequency impedance ZacL allowing the output deterioration of the air-fuel ratio sensor is afvmin and the maximum allowance is afvmax. When ZacLav is afvmin, the deviation of the output of the air-fuel ratio sensor is −X and when ZacLav is afvmax, the deviation of the output of the air-fuel ratio sensor is +X.

Figure 37:
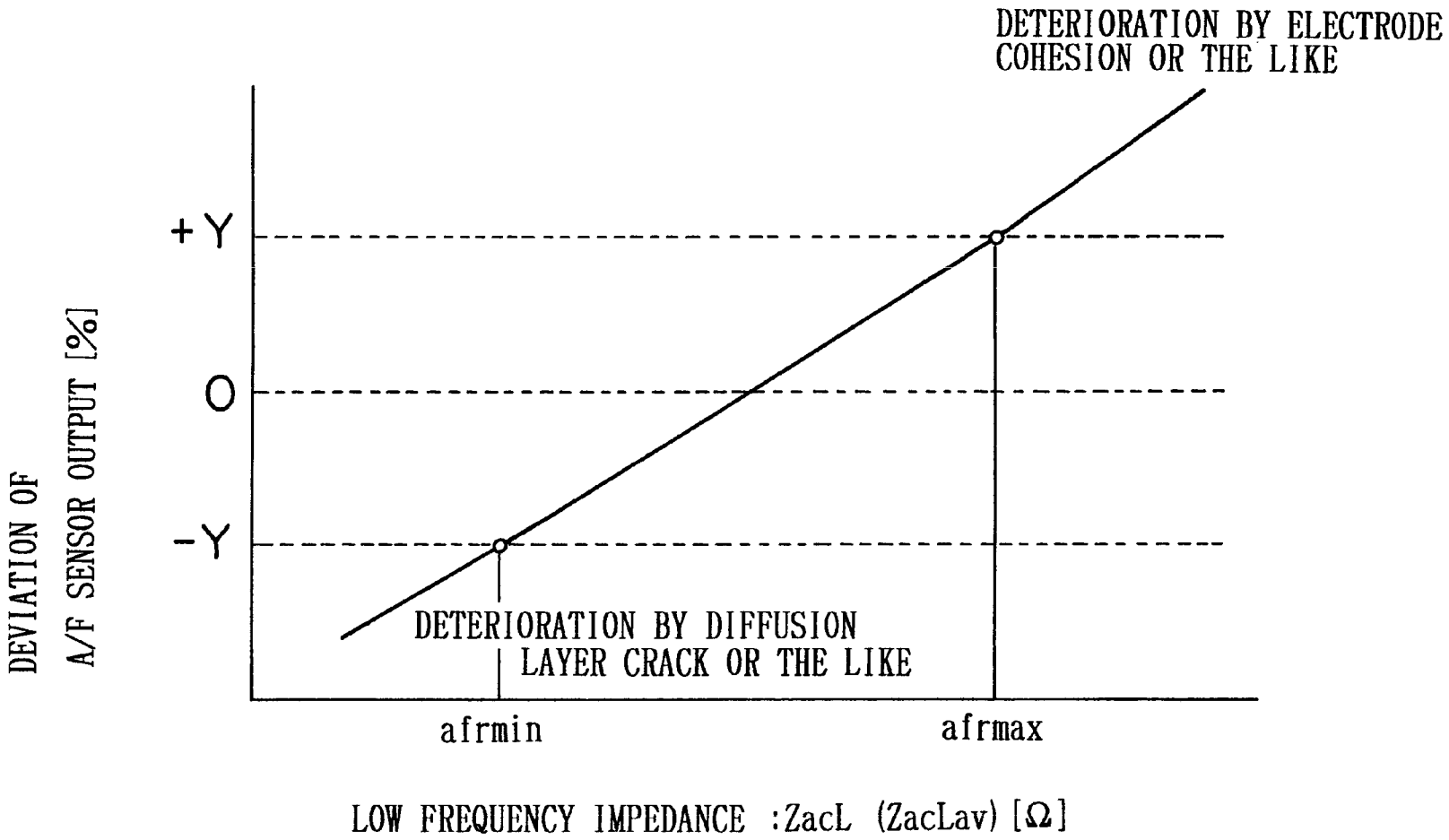
FIG. 37 is a diagram showing a correlation between deviation of the response of the air-fuel ratio sensor and low frequency impedance under high frequency impedance.

FIG. 37 is a diagram showing a correlation between the deviation of the response of the air-fuel ratio sensor and the low frequency impedance under a constant high frequency impedance. The correlation shown in FIG. 37 changes depending on the temperature of the sensor element or the high frequency impedance. When the low frequency impedance ZacL decreases after the deterioration in durability (ZacL1), the DC resistance Ri decreases so that the response of the air-fuel ratio sensor shifts to negative side or in the direction that the response is accelerated (−Y, Y>0). When ZacL increases after the deterioration in durability (ZacL2), the DC resistance Ri also increases so that the response of the air-fuel ratio sensor shifts to positive side or in a direction that the response is decelerated (+Y). When the deviation of the response of the air-fuel ratio sensor exceeds −Y and shifts to the negative side, it is determined that the sensor element is deteriorated due to diffusion layer crack or the like. Further, when the deviation of the response exceeds +Y and further shifts to the positive side, it is determined that the sensor element is deteriorated due to electrode cohesion or the like. The minimum allowance of the average ZacLav of the low frequency impedance ZacL allowing the response deterioration of the air-fuel ratio sensor is afrmin and the maximum allowance is afrmax. When ZacLav is afrmin, the deviation of the response of the air-fuel ratio sensor is −Y and when ZacLav is afrmax, the deviation of the response of the air-fuel ratio sensor is +Y.

A concrete processing for determining the deterioration of the air-fuel ratio sensor from the low frequency impedance described with reference to FIGS. 34 to 37 will be described with reference to FIGS. 38 to 44.

Figure 38:
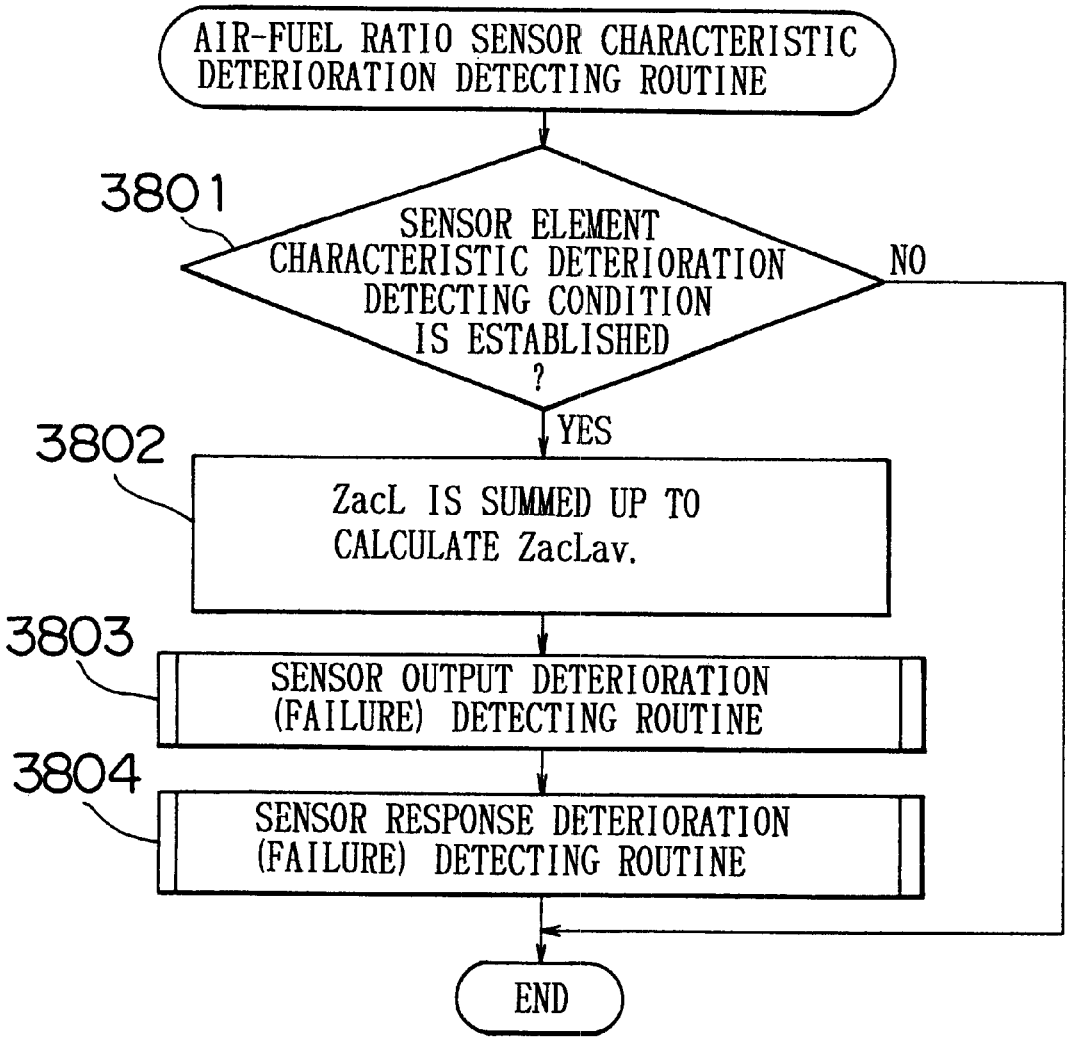
FIG. 38 is a flow chart of characteristic deterioration detecting routine of the air-fuel ratio sensor.

FIG. 38 is a flow chart of the characteristic deterioration detecting routine of the air-fuel ratio sensor. This routine is carried out at a predetermined cycle, for example, every 100 msec. In step 3801, it is determined whether or not the following characteristic deterioration detecting conditions 1–4 are all established to determined whether the characteristic of the sensor element is deteriorated. If YES, the process proceeds to step 3802. If NO, this routine is terminated.

1. Stop of hot idle
2. Activation of the air-fuel ratio sensor
3. During air-fuel ratio feedback
4. Within a predetermined air-fuel ratio (near a theoretical air-fuel ratio).

In step 3802, when the engine reaches its predetermined number of revolutions, the low frequency impedances ZacL are summed up and its average ZacLav is stored as ZacLG.

Next in step 3803, the sensor output deterioration detecting routine (FIG. 39) is carried out and in step 3804, the sensor response deterioration detecting routine (FIG. 42) is carried out.

Figures 39, 40:
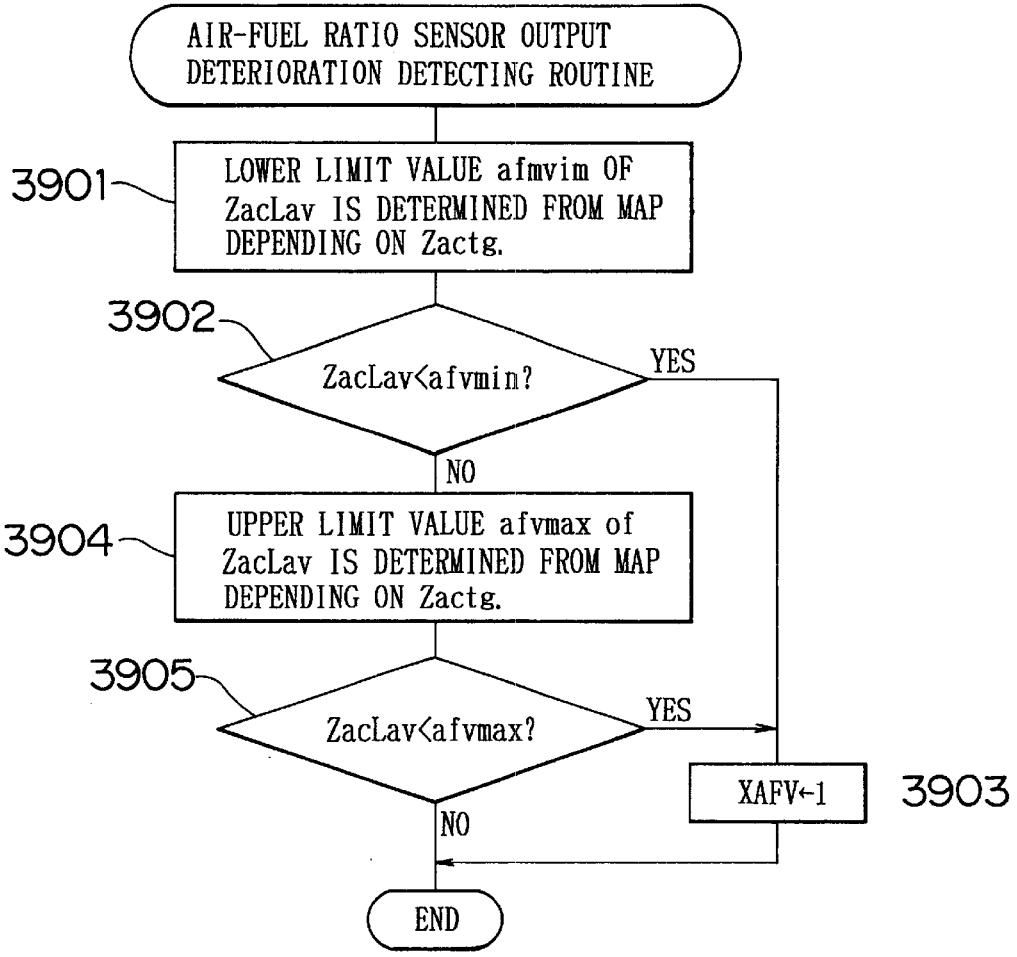
FIG. 39 is a flow chart of output deterioration detecting routine of the air-fuel ratio sensor.
FIG. 40 is a map for calculating a lower limit value of an average of low frequency impedance allowing an output deterioration of the air-fuel ratio sensor from an element temperature control target value.
Figures 41, 42:
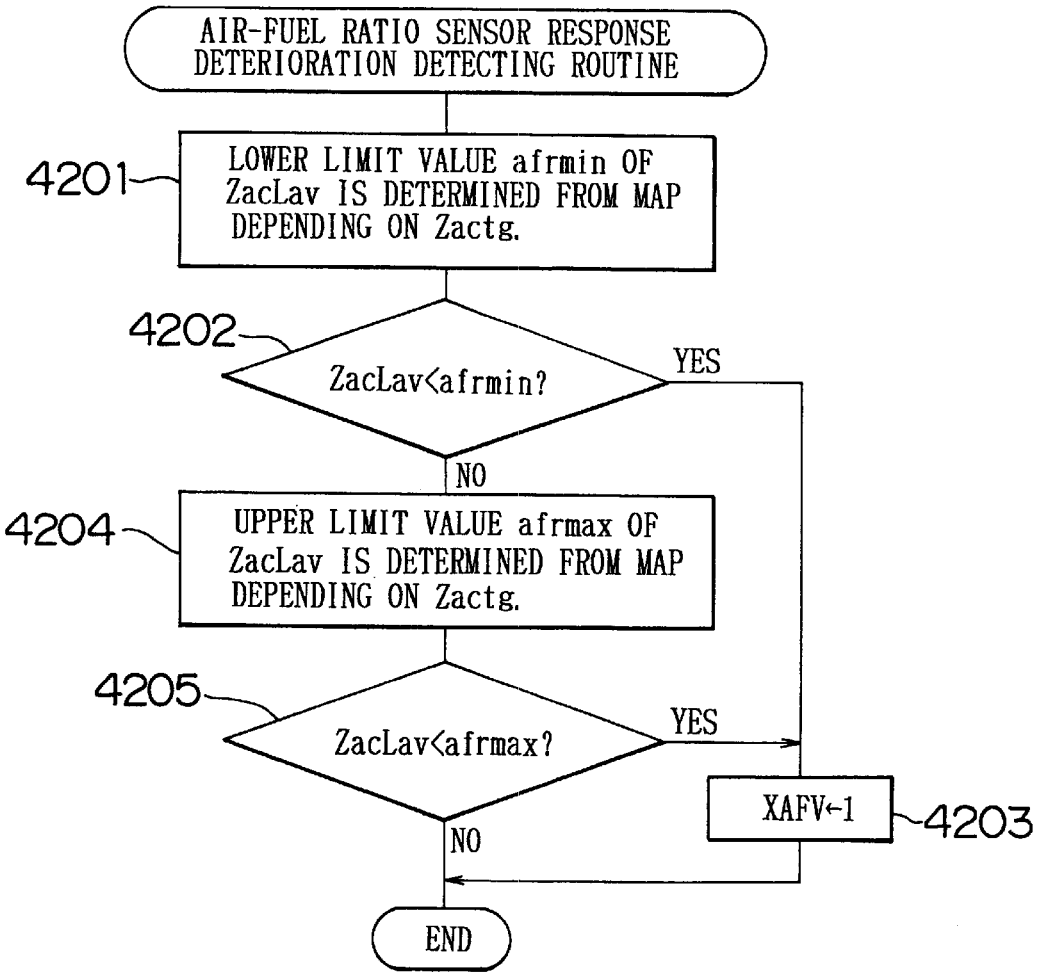
FIG. 41 is a map for calculating a upper limit value of an average of low frequency impedance allowing an output deterioration of the air-fuel ratio sensor from an element temperature control target value.
FIG. 42 is a flow chart of response deterioration detecting routine of the air-fuel ratio sensor.

FIG. 39 is a flow chart of the output deterioration detecting routine of the air-fuel ratio sensor and FIG. 40 is a map for calculating the lower limit value of the average of the low frequency impedance allowing the output deterioration of the air-fuel ratio sensor from the element temperature control target value. FIG. 41 is a map for calculating a upper limit value of the average of the low frequency impedance allowing the output deterioration of the air-fuel ratio sensor from the element temperature control target value. A routine shown in FIG. 39 determines an output error of the air-fuel ratio sensor according to the element temperature control target value Zactg which is the high frequency impedance ZacH and the average ZacLav of the low frequency impedance calculated in step 3802.

First in step 3901, the lower limit value afvmin of the ZacLav allowing the output deterioration of the air-fuel ratio sensor is calculated from the element temperature control target value Zactg corresponding to the high frequency impedance based on the map shown in FIG. 40. In step 3902, it is determined whether or not the ZacLav is larger than the afvmin calculated in step 3901. If ZacLav<afvmin, it is determined that the sensor element is abnormal and the processing proceeds to step 3903. If ZacLav≧afvmin, the process proceeds to step 3904. In step 3904, the upper limit value afvmax of the ZacLav allowing the output deterioration of the air-fuel ratio sensor is calculated from the element temperature control target value Zactg corresponding to the high frequency impedance based on the map shown in FIG. 41. In step 3902, it is determined whether or not the ZacLav is smaller than the afvmax calculated in step 3901. If ZacLav>afvmax, it is determined that the sensor element is abnormal and the processing proceeds to step 3903. If ZacLav<afvmax, this routine is terminated. In step 3903, the flag XAFV indicating that the output of the air-fuel ratio sensor is deteriorated is set to 1.

As described above, in the air-fuel ratio sensor output deterioration detecting routine, the air-fuel ratio sensor failure determination values afvmin and afvmax are set corresponding to the element temperature control target value Zactg or the high frequency impedance.

Figures 44, 45:
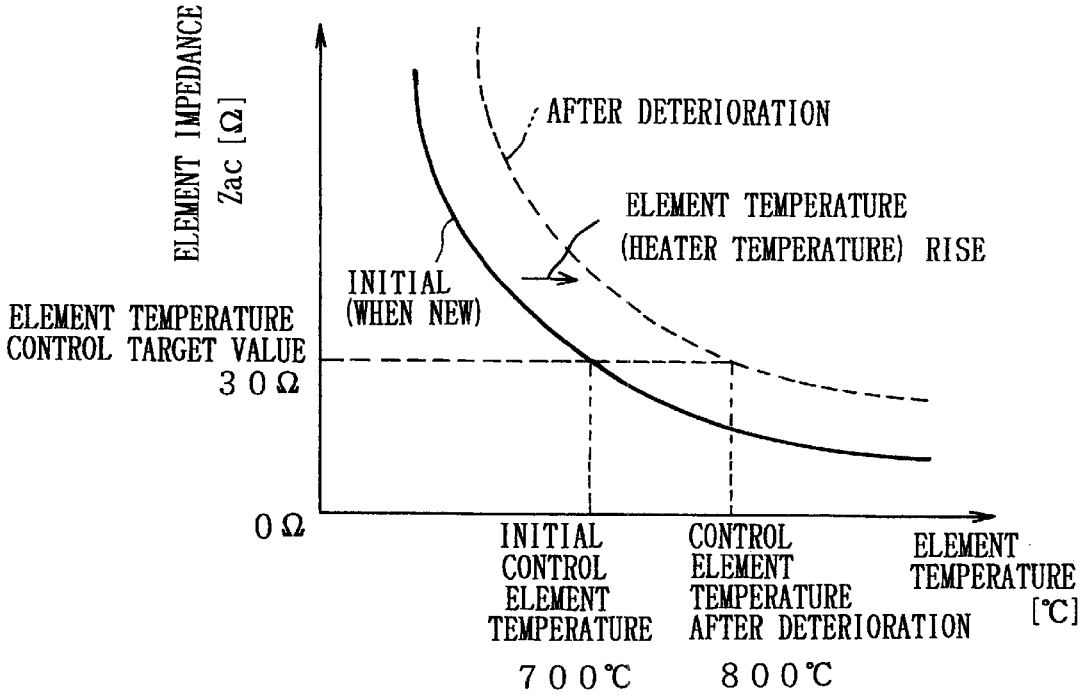
FIG. 44 is a map for calculating a upper limit value of the average of low frequency impedance allowing response deterioration of the air-fuel ratio sensor from an element temperature control target value.
FIG. 45 is a diagram showing a correlation between a temperature of the oxygen concentration detecting element and impedance.
Figure 46B:
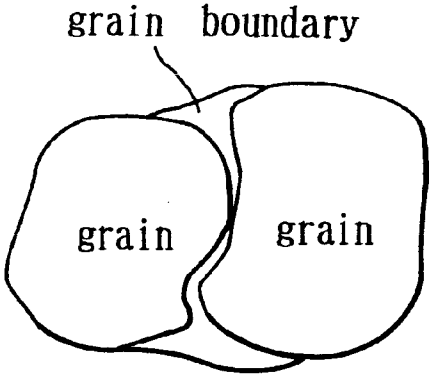
FIG. 46B is a partially enlarged diagram of electrolyte portion of the air-fuel ratio sensor element.
Figure 46A:
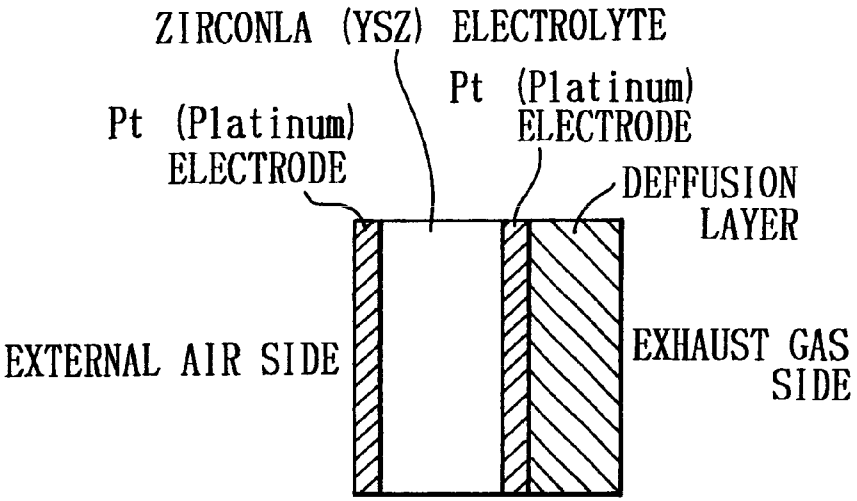
FIG. 46A is a diagram showing a sectional structure of the air-fuel ratio sensor element.

FIG. 42 is a flow chart of the response deterioration detecting routine of the air-fuel ratio sensor and FIG. 43 is a map for calculating the lower limit value of the average of the low frequency impedance allowing the response deterioration from the element temperature control target value. FIG. 44 is a map for calculating the upper limit value of the average of the low frequency impedance allowing the response deterioration of the air-fuel ratio sensor from the element temperature control target value. A routine shown in FIG. 42 determines response error of the air-fuel ratio sensor from the element temperature control target value Zactg which is the high frequency impedance ZacH and the average value ZacLav of the low frequency impedance calculated in step 3802.

First in step 4201, the lower limit value afrmin of the ZacLav allowing the response deterioration of the air-fuel ratio sensor is calculated from the element temperature control target value Zactg corresponding to the high frequency impedance based on the map shown in FIG. 43. In step 4202, it is determined whether or not the ZacLav is larger than afrmin calculated in step 4201. If ZacLav<afrmin, it is determined that the sensor element is in trouble and the processing proceeds to step 4203. If ZacLav>afrmin, the process proceeds to step 4204. In step 4204, the upper limit value afrmax of the ZacLav allowing the response deterioration of the air-fuel ratio sensor is calculated from the Zactg corresponding to the high frequency impedance based on the map shown in FIG. 44. In step 4202, it is determined whether or not the ZacLav is smaller than the afrmax calculated in step 4201. If ZacLav>afrmax, it is determined that the sensor element is in trouble and the processing proceeds to step 4203. If ZacLav≦afrmax, this routine is terminated. In step 4203, the flag XAFR indicating that the response of the air-fuel ratio sensor is deteriorated is set to 1.

As described above, in the air-fuel ratio sensor response deterioration detecting routine, the air-fuel ratio sensor failure determination values afrmin and afrmax are set up corresponding to the element temperature control target value Zactg or the high frequency impedance.

A flow chart of a processing routine after the deterioration of the air-fuel ratio sensor is determined is shown in FIG. 25. The routine shown in FIG. 25 is carried out at a predetermined cycle, for example, every 1 msec. In step 2501, it is determined whether or not the air-fuel ratio sensor is in trouble depending on whether or not the air-fuel ratio sensor output deterioration determination flag XAFV or response deterioration determination flag XAFR is posted. If XAFV=1 or XAFR=1, XFAFS is set to 1 so that it is determined that the air-fuel ratio sensor is deteriorated. The following steps 2502 to 2504 are carried out.

By detecting the characteristic deterioration of the air-fuel ratio sensor described with reference to FIGS. 38 to 44, an over temperature of the air-fuel ratio sensor element is detected and the characteristic deterioration of the air-fuel ratio sensor is detected by the over temperature. Thus, the electric power amount supplied to the heater of the air-fuel ratio sensor does not have to be calculated and the characteristic deterioration of the air-fuel ratio sensor does not have to be detected from a trajectory of the output of the air-fuel ratio sensor under a predetermined operating condition of the engine. Therefore, the deterioration can be determined only from the air-fuel ratio sensor without being affected by the operating condition of the engine.

As described above, the control device of the air-fuel ratio sensor of the present invention detects the air-fuel ratio with high accuracy from the output value of the air-fuel ratio sensor by accurately detecting the characteristic change of the air-fuel ratio sensor element. Further, this control device of the air-fuel ratio sensor determines a failure or activation of the air-fuel ratio sensor accurately.

According to the present invention, as the output characteristic of the air-fuel ratio sensor is maintained at a constant level without being affected by an influence by aging. Therefore, the control device of the air-fuel ratio sensor detects an air-fuel ratio with high accuracy from the output value of the air-fuel ratio sensor.

Further, according to the present invention, as the output signal of the air-fuel ratio sensor can be used for air-fuel ratio feedback control at low temperatures before the air-fuel ratio sensor element is activated, discharge of exhaust gas when the engine is started is carried out excellently.

What is claimed is:

1. An air-fuel ratio sensor control device detecting a current from an oxygen concentration detecting element by applying a voltage to the oxygen concentration detecting element, the current corresponding to a concentration of oxygen in a detected gas, the control device comprising:

an impedance detecting device applying AC voltages at a plurality of frequencies to the oxygen concentration detecting element, the impedance detecting device detecting an AC impedance of the oxygen concentration detecting element at each of the plurality of frequencies;

a temperature adjusting device adjusting a temperature of the oxygen concentration detecting element based on a first impedance corresponding to a first one of the plurality of frequencies; and a characteristic change detecting device detecting a characteristic change of the oxygen concentration detecting element based on a second impedance corresponding to a second one of the plurality of frequencies, the second frequency being lower than the first frequency.

2. An air-fuel ratio sensor control device according to claim 1, wherein the characteristic change detecting device detects a failure of the oxygen concentration detecting element.

3. An air-fuel ratio sensor control device according to claim 2, wherein the characteristic change detecting device detects a failure of the oxygen concentration detecting element based on the first impedance.

4. An air-fuel ratio sensor control device according to claim 2 further comprising:

an alarm indicating the detection of a failure in the oxygen concentration detecting element by the characteristic change detecting device.

5. An air-fuel ratio sensor control device according to claim 1, wherein the characteristic change detecting device changes an output value of the oxygen concentration detecting element.

6. An air-fuel ratio sensor control device according to claim 5, wherein the characteristic change detecting device changes the output value of the oxygen concentration detecting element based on the second impedance.

7. An air-fuel ratio sensor control device according to claim 6, wherein the characteristic change detecting device changes the output value of the oxygen concentration detecting element based on an initial value of the second impedance and a change amount from the initial value.

8. An air-fuel ratio sensor control device according to claim 1, wherein the temperature adjusting device energizes a heater provided in the oxygen concentration detecting element to heat the oxygen concentration detecting element based on the first impedance and a target temperature of the oxygen concentration detecting element.

9. An air-fuel ratio sensor control device according to claim 1, wherein the temperature adjusting device changes the target temperature based on the second impedance.

10. An air-fuel ratio sensor control device according to claim 1 further comprising:

an air-fuel ratio determining device determining an air-fuel ratio based on the second impedance when the temperature of the oxygen concentration detecting element is within a first temperature range, and determines the air-fuel ratio based on the first impedance when the temperature of the oxygen concentration detecting element is within a second temperature range, the second temperature range being higher than the first temperature range.

11. An air-fuel ratio sensor control device according to claim 10, wherein a lower end of the second temperature range is higher than an upper end of the first temperature range.

12. An air-fuel ratio sensor control device according to claim 10 further comprising:

an air-fuel ratio controller controlling the air-fuel ratio based on an output value of the oxygen concentration detecting element, using as feedback the air-fuel ratio determined by the air-fuel ratio determining device, wherein, when the temperature of the oxygen concentration detecting element is in the first temperature range, an air-fuel ratio feedback control gain of the air-fuel ratio controller is lower than an air-fuel ratio feedback control gain of the air-fuel ratio controller when the temperature of the oxygen concentration detecting element is in the second temperature range.

* * * * *